US009430973B2

(12) United States Patent
Choi et al.

(10) Patent No.: US 9,430,973 B2
(45) Date of Patent: Aug. 30, 2016

(54) DISPLAY DEVICE AND PROCESSING METHOD OF IMAGE SIGNAL THEREOF

(71) Applicant: Samsung Display Co., Ltd., Yongin, Gyeonggi-Do (KR)

(72) Inventors: Nam-Gon Choi, Asan-si (KR); Yong Jun Jang, Yongin-si (KR); Jung-Won Kim, Seoul (KR); Geun Jeong Park, Daegu (KR); Ji-Woong Jeong, Yongin-Si (KR); Uk Chul Choi, Cheonan-si (KR); Joon-Chul Goh, Hwaseong-si (KR); Cheol Woo Park, Suwon-si (KR); Bong Hyun You, Yangju-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 302 days.

(21) Appl. No.: 13/964,351

(22) Filed: Aug. 12, 2013

(65) Prior Publication Data

US 2014/0232756 A1 Aug. 21, 2014

(30) Foreign Application Priority Data

Feb. 20, 2013 (KR) ..... 10-2013-0018223

(51) Int. Cl.
*G09G 3/36* (2006.01)
*G09G 3/20* (2006.01)

(52) U.S. Cl.
CPC ..... *G09G 3/36* (2013.01); *G09G 3/2025* (2013.01); *G09G 3/3648* (2013.01); *G09G 3/3696* (2013.01); *G09G 2320/0252* (2013.01); *G09G 2320/0673* (2013.01); *G09G 2340/0435* (2013.01); *G09G 2340/16* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 7,298,352 | B2 | 11/2007 | Kang et al. | |
| 2008/0069479 | A1 * | 3/2008 | Park et al. | 382/300 |
| 2008/0143754 | A1 * | 6/2008 | Lee | 345/690 |
| 2009/0009509 | A1 | 1/2009 | Tagami | |
| 2011/0057959 | A1 * | 3/2011 | Park | G09G 3/3648 345/690 |

FOREIGN PATENT DOCUMENTS

| | | | |
|---|---|---|---|
| EP | 1884916 | A2 | 2/2008 |
| KR | 1020080026406 | | 3/2008 |

OTHER PUBLICATIONS

European Search Report dated Jan. 28, 2014.

* cited by examiner

*Primary Examiner* — Seokyun Moon
(74) *Attorney, Agent, or Firm* — F. Chau & Associates, LLC

(57) ABSTRACT

A image signal processing method of a liquid crystal display according to an exemplary embodiment of the present invention includes: receiving a previous image signal and a current image signal as two sequential input image signals; performing a first correction (DCC) and a doubling for the current image signal to generate a correction image signal comprising a plurality of doubled frames for the current image signal; and post-processing the portion of the plurality of doubled frames to generate a final correction image signal.

25 Claims, 21 Drawing Sheets

FIG.19

| W(g) | Rising | | Falling | |
|---|---|---|---|---|
| | Fit | Break | Fit | Break |
| HL-LH mode | 0 <= W(g) <= 1 | 1 <= W(g) | 0 <= W(g) <= 1 | 1 <= W(g) |
| LH-HL mode | 1 <= W(g) | 0 <= W(g) <= 1 | 1 <= W(g) | 0 <= W(g) <= 1 |

FIG.22

| Fg | Rising | Falling |
|---|---|---|
| Fit | 2'b11 | 2'b10 |
| Break | 2'b01 | 2'b00 |

HL-LH mode

FIG.23

| Fg | Rising | Falling |
|---|---|---|
| Fit | 2'b01 | 2'b00 |
| Break | 2'b11 | 2'b10 |

LH-HL mode

DISPLAY DEVICE AND PROCESSING METHOD OF IMAGE SIGNAL THEREOF

CROSS-REFERENCE TO RELATED APPLICATION

This application claims priority to Korean Patent Application No. 10-2013-0018223 filed in the Korean Intellectual Property Office on Feb. 20, 2013, the disclosure of which is incorporated by reference herein.

BACKGROUND (a) Technical Field

Exemplary embodiments of the present invention relate to a liquid crystal display and a processing method of an image signal thereof.

(b) Discussion of Related Art

Display devices such as a liquid crystal display (LCD) and an organic light emitting device may include a display panel that includes a plurality of pixels including switching elements and a plurality of signal lines, a gray voltage generator that generates a gray reference voltage, and a data driver that uses the gray reference voltage to generate a plurality of gray voltages and applies a gray voltage corresponding to an input image signal among the generated gray voltages to a data line as a data signal.

The liquid crystal display includes two display panels including pixel electrodes and opposing electrodes, and a liquid crystal layer disposed therebetween and having dielectric anisotropy. The pixel electrodes are arranged in a matrix type and are connected to switching elements such as a thin film transistor (TFT), and sequentially receive a data voltage column-by-column. The opposing electrodes are formed over the display panel and are applied with a common voltage Vcom. A voltage applied to the pixel electrodes and the opposing electrodes generates an electric field in the liquid crystal layer, and a strength of the electric field is controlled to control transmittance of light transmitting through the liquid crystal layer, thereby obtaining desired images.

However, since the response speed of the liquid crystal molecules is slow, a predetermined time is required until the pixel voltage of the liquid crystal capacitor reaches a target voltage, which is a voltage used to acquire desired luminance, and the time is changed by a difference of the voltage previously charged in the liquid crystal capacitor. Therefore, for example, when a difference between the target voltage and the previous voltage is large, if only the target voltage is applied from the start, it may not reach the target voltage while the switching element is turned on.

SUMMARY

At least one embodiment of the present invention provides a liquid crystal display, which may prevent display quality deterioration due to a slow liquid crystal response speed while improving transmittance and lateral visibility to increase display quality, and a driving method thereof.

A method of processing an image signal according to an exemplary embodiment of the present invention includes: receiving a previous image signal and a current image signal as two sequential input image signals; performing a first correction (DCC) and a doubling for the current image signal to generate a correction image signal of a plurality of doubled frames for the current image signal; and a portion of the plurality of doubled frames to generate a final correction image signal.

The generating of the correction image signal of the plurality of doubled frames may include: doubling the current image signal or the correction image signal into the plurality of doubled frames according to a TGM mode; and first correcting the current image signal or the doubled current image signal of the plurality of doubled frames.

A gamma curve applied to the plurality of doubled frames may include a first gamma curve and a second gamma curve, a luminance of a first image (H) of one of the doubled frames according to the first gamma curve may be not lower than luminance of a second image (L) of the one doubled frame according to the second gamma curve for an input image signal, and the TGM mode applied to the plurality of doubled frames for two sequential input images may include an HL-LH mode and an LH-HL mode.

The performing may include setting a luminance of the input image signal to one of change condition may include a break condition (Break) in which the luminance of the input image signal is changed in a middle of the TGM mode or a fit condition (Fit) in which the luminance of the input image signal is changed between two adjacent TGM modes, and setting a luminance of the current image signal to one of a rising condition (Rising) in which the luminance of the current image signal is higher than the luminance of the previous image signal or a falling condition (Falling) in which the luminance of the current image signal is lower than the luminance of the previous image signal.

The flag signal may have four values according to the set condition for the HL-LH mode and the LH-HL mode, and the value of the flag signal of the HL-LH mode may form a pair along with the value of the flag signal of the LH-HL mode and may have the same value.

The generating of the final correction image signal may include outputting the current image signal before the first correction as the final correction image signal, or multiplying the portion of the plurality of doubled frames by a weight value and outputting the multiplied result as the final correction image signal.

The weight value may be selected using the value of the flag signal.

The weight value of the rising condition and the fit condition in the HL-LH mode and the weight value of the rising condition and the break condition in the LH-HL mode may be equal to or more than 0 and equal to or less than 1, the weight value of the rising condition and the break condition in the HL-LH mode and the weight value of the rising condition and the fit condition in the LH-HL mode may be equal to or more than 1, the weight value of the falling condition and the fit condition in the HL-LH mode and the weight value of the falling condition and the break condition in the LH-HL mode may be equal to or more than 0 and equal to or less than 1, and the weight value of the falling condition and the break condition in the HL-LH mode and the weight value of the falling condition and the fit condition in the LH-HL mode may be equal to or more than 1.

The generating of the correction image signal of the plurality of doubled frames and the generating of the final correction image signal may include generating the correction image signal by the first correcting of the current image signal, doubling the correction image signal into the plurality of doubled frames, and post-processing the portion of the plurality of doubled frames using the flag signal.

The generating of the correction image signal of the plurality of doubled frames and the generating of the final correction image signal may include generating the correction image signal by the first correcting of the current image signal, adding the flag signal to a lower bit of the correction image signal, doubling the correction image signal added by the flag signal into the plurality of doubled frames, and post-processing the portion of the plurality of doubled frames using the flag signal added to the lower bit of the correction image signal.

The generating of the correction image signal of the plurality of doubled frames and the generating of the final correction image signal may include doubling the current image signal into the plurality of doubled frames, generating the correction image signal by the first correcting of the doubled current image signal, and post-processing the portion of the plurality of doubled frames using the flag signal.

The generating of the correction image signal of the plurality of doubled frames and the generating of the final correction image signal may include doubling the current image signal into the plurality of doubled frames, adding the flag signal to a lower bit of the previous image signal, generating the correction image signal by the first correcting of the doubled current image signal, and post-processing the portion of the plurality of doubled frames using the flag signal added to the lower bit of the previous image signal.

A liquid crystal display according to an exemplary embodiment of the present invention includes an image signal processor receiving a previous image signal and a current image signal as two sequential input image signals, and performing a first correction (DCC) and a doubling for the current image signal to generate a correction image signal comprising a plurality of doubled frames that are doubled for the current image signal, wherein the image signal processor includes a post processor for post-processing a portion of the plurality of doubled frames to generate a final correction image signal.

The image signal processor may include a TGM unit doubling the current image signal or the correction image signal into the plurality of doubled frames according to a TGM mode, and a DCC unit first correcting the current image signal or the doubled current image signal of the plurality of doubled frames.

A gamma curve applied to the plurality of doubled frames may include a first gamma curve and a second gamma curve, luminance of a first image (H) according to the first gamma curve may not be lower than luminance of a second image (L) according to the second gamma curve for an input image signal, and the TGM mode applied to the plurality of doubled frames for two sequential input images may include an HL-LH mode and an LH-HL mode.

A condition for changing the luminance of the input image may include one of a break condition (Break) in which the luminance of the input image signal is changed in a middle of the TGM mode or a fit condition (Fit) in which the luminance of the input image signal is changed between two adjacent TGM modes. A condition for changing the luminance of the current image signal may include one of a rising condition (Rising) in which the luminance of the current image signal is higher than the luminance of the previous image signal or a falling condition (Falling) in which the luminance of the current image signal is lower than the luminance of the previous image signal.

The liquid crystal display may include a comparator comparing the previous image signal and the current image signal to generate a flag signal for the luminance change condition may be further included, and the post processor may post-process the portion of the plurality of doubled frames to generate the final correction image signal.

The flag signal may have four values according to the luminance condition for each of the HL-LH mode and the LH-HL mode, and a value of the flag signal for the HL-LH mode may form a pair along with a value of the flag signal for the LH-HL mode and may have a same value.

The post processor may output the current image signal before the first correction as the final correction image signal, or may multiply the correction image signal of the portion of the plurality of doubled frames by a weight value and outputs the multiplied result as the final correction image signal.

The weight value may be selected using the value of the flag signal.

The weight value of the rising condition and the fit condition in the HL-LH mode and the weight value of the rising condition and the break condition in the LH-HL mode may be equal to or more than 0 and equal to or less than 1, the weight value of the rising condition and the break condition in the HL-LH mode and the weight value of the rising condition and the fit condition in the LH-HL mode may be equal to or more than 1, the weight value of the falling condition and the fit condition in the HL-LH mode and the weight value of the falling condition and the break condition in the LH-HL mode may be equal to or more than 0 and equal to or less than 1, and the weight value of the falling condition and the break condition in the HL-LH mode and the weight value of the falling condition and the fit condition in the LH-HL mode may be equal to or more than 1.

The DCC unit may output the correction image signal generated by the first correction of the current image signal to the TGM unit, the TGM unit may double the correction image signal into the plurality of doubled frame and outputs the doubled correct image signal to the post processor, and the post processor may post-process the portion of the plurality of doubled frames using the flag signal from the comparator.

The DCC unit may output the correction image signal generated by the first correction of the current image signal to the TGM unit, the comparator may add the flag signal to a lower bit of the correction image signal and outputs the correction image signal added by the flag signal to the TGM unit, the TGM unit may double the correction image signal added by the flag signal into the plurality of doubled frames and outputs the doubled correction mage signal added by the flag signal to the post processor, and the post processor may post-process the plurality of doubled frames using the flag signal added to the lower bit of the correction image signal.

The TGM unit may double the current image signal into the plurality of doubled frames and outputs the doubled current image signal to the DCC unit, the DCC unit may output the correction image signal generated by the first correction of the doubled current image signal to the post processor, and the post processor may post-process the plurality of doubled frames using the flag signal from the comparator.

The TGM unit may double the current image signal into the plurality of doubled frames and outputs the doubled current image signal to the DCC unit, the comparator may add the flag signal to the lower bit of the previous image signal and outputs the previous image signal added by the flag signal to the DCC unit, the DCC unit may output the correction image signal generated by the first correction of the doubled current image signal to the post processor, and the post processor may post-process the plurality of doubled frames using the flag signal added to the lower bit of the previous image signal.

According to at least one exemplary embodiment of the present invention, while improving the transmittance and the lateral visibility of the liquid crystal display, the display quality degradation due to the slow liquid crystal response speed may be prevented, thereby increasing the display quality of the liquid crystal display.

According to an exemplary embodiment of the invention, a method of processing an image signal of a liquid crystal display includes performing a dynamic capacitance compensation (DCC) and a doubling based on a current image signal to generate a correction image signal comprising a plurality of doubled frames and post-processing a portion of the plurality of doubled frames to generate a final correction image signal.

The performing may include doubling the current image according to a temporal gamma mixing TGM mode and performing the DCC on a result of the doubling and a previous image signal. The performing may instead include performing the DCC on a previous image signal and the current image signal and doubling a result of performing the DCC according to a temporal gamma mixing TGM mode. The performing may instead include doubling the current image according to a temporal gamma mixing TGM mode, comparing the current image signal and a previous image signal to generate a flag, appending the flag to the previous image signal to generate a modified previous image signal, and performing the DCC on a result of the doubling and the modified previous image signal.

BRIEF DESCRIPTION OF THE DRAWINGS

FIG. 19 is a table of one example of a weight value applied to post-processing in a liquid crystal display according to an exemplary embodiment of the present invention, FIG. 22 is a view of one example of a flag signal applied to an HL-LH mode of a TGM type in an image signal processing process in a liquid crystal display according to an exemplary embodiment of the present invention, FIG. 23 is a view of one example of a flag signal applied to an LH-HL mode of a TGM type in an image signal processing process in a liquid crystal display according to an exemplary embodiment of the present invention.

DETAILED DESCRIPTION

The present invention will be described more fully hereinafter with reference to the accompanying drawings, in which exemplary embodiments of the invention are shown. However, the described embodiments may be modified in various different ways, all without departing from the spirit or scope of the present invention.

A liquid crystal display and a driving method thereof according to an exemplary embodiment of the present invention will be described with reference to accompanying drawings.

Firstly, a liquid crystal display according to an exemplary embodiment of the present invention will be described with reference to FIG. 1 to FIG. 3.

Figure 1:
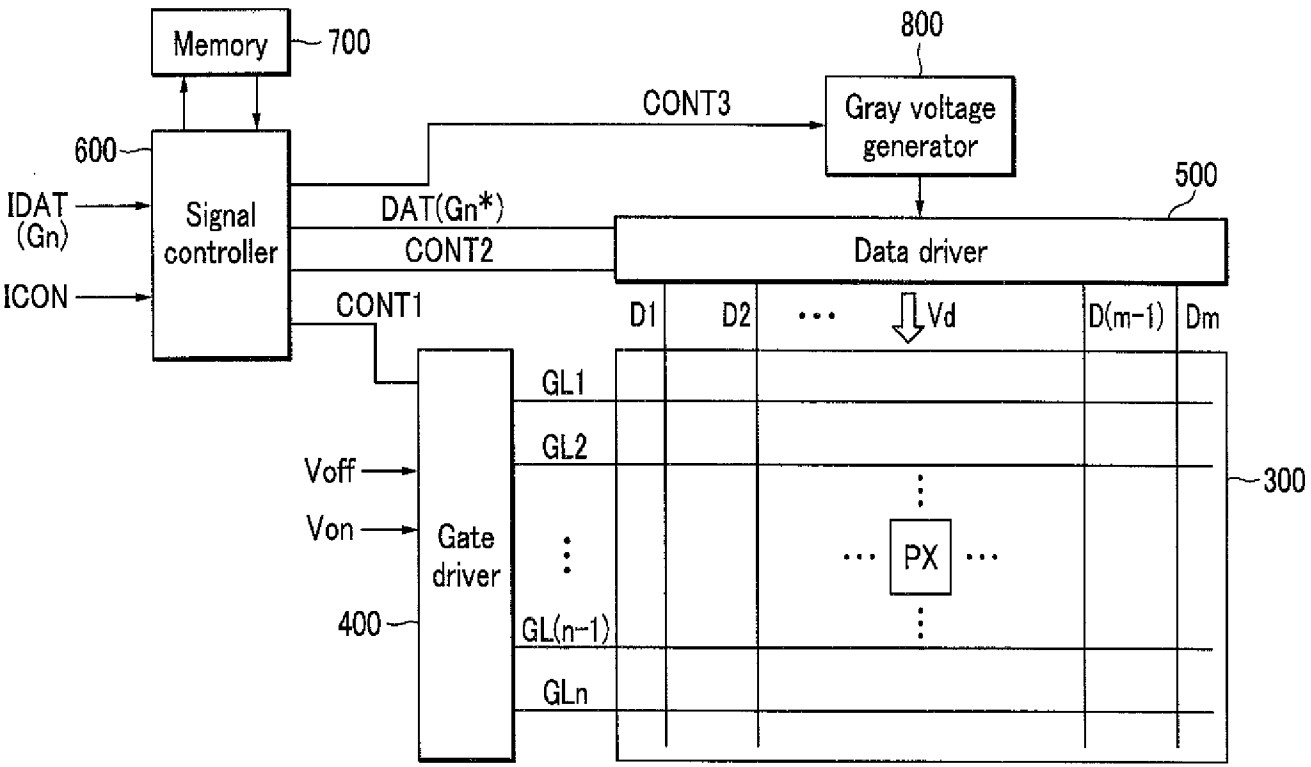
FIG. 1 is a block diagram of a liquid crystal display according to an exemplary embodiment of the present invention.
Figure 2:
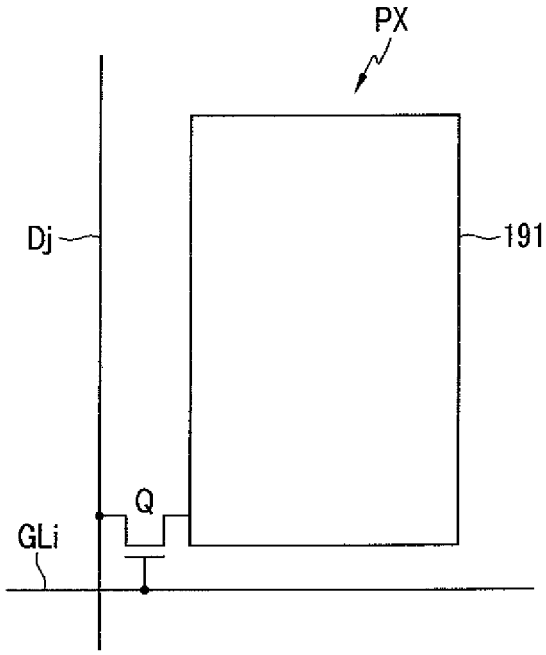
FIG. 2 is a circuit diagram of one pixel of a liquid crystal display according to an exemplary embodiment of the present invention.
Figure 3:
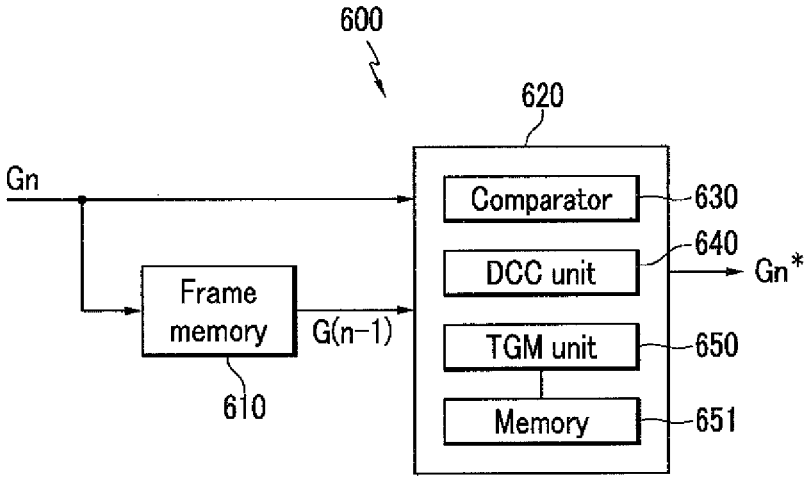
FIG. 3 is a block diagram of a signal controller of a liquid crystal display according to an exemplary embodiment of the present invention.

FIG. 1 is a block diagram of a liquid crystal display according to an exemplary embodiment of the present invention, FIG. 2 is a circuit diagram of one pixel of a liquid crystal display according to an exemplary embodiment of the present invention, and FIG. 3 is a block diagram of a signal controller of a liquid crystal display according to an exemplary embodiment of the present invention.

Referring to FIG. 1, a liquid crystal display according to an exemplary embodiment of the present invention includes a display panel 300, a gate driver 400 and a data driver 500 connected to the display panel 300, a gray voltage generator 800 connected to the data driver 500, a signal controller 600 controlling them, and a memory 700 connected to the signal controller 600.

In a viewpoint of an equivalent circuit, the display panel 300 includes a plurality of signal lines, and a plurality of pixels PX connected thereto and arranged in an approximate matrix. A lower panel and an upper panel (not shown) facing each other and a liquid crystal layer (not shown) interposed therebetween may be included in a viewpoint of a cross-section of the display panel 300.

The signal lines include a plurality of gate lines GL1-GLn transmitting a gate signal (referred to as "a scanning signal") and a plurality of data lines D1-Dm transmitting a data voltage.

Referring to FIG. 2, one pixel PX included in the liquid crystal display according to an exemplary embodiment of the present invention includes at least one switching element Q connected to at least one data line Dj (j=1, . . . , m) and at least one gate line GLi (i=1, . . . , n) and at least one pixel electrode 191 is connected thereto. The switching element Q may include at least one thin film transistor, and is controlled according to the gate signal transmitted by the gate line GLi thereby transmitting the data voltage Vd transmitted by the data line Dj to the pixel electrode 191. According to an exemplary embodiment of the present invention, one pixel PX includes at least two subpixels capable of displaying different luminances.

In a color display embodiment, each pixel PX displays one of the primary colors (spatial division) or alternately displays the primary colors according to time (temporal division) so that a desired color is recognized by the spatial and temporal sum of the primary colors. The plurality of adjacent pixels PX which display different primary colors may form one set (referred to as a dot) together.

The gate driver 400 is connected to the gate lines GL1-GLn to apply a gate signal formed by combining a gate-on voltage Von and a gate-off voltage Voff to the gate lines GL1-GLn.

The gray voltage generator 800 generates all gray voltages or a limited number of gray voltages (hereinafter referred to as "reference gray voltages") related to transmittance of the pixels PX. The (reference) gray voltage may be positive or negative with respect to the common voltage Vcom. The gray voltage generator 800 may receive the gamma data from the signal controller 600 to generate the (reference) gray voltage based on the gamma data.

The data driver 500 is connected to the data lines D1-Dm, selects a gray voltage from the gray voltage generator 800, and applies the selected gray voltage to the data line as a data signal. However, when the gray voltage generator 800 does not provide the voltage for all gray levels, but provides the reference gray voltages, in an exemplary embodiment, the data driver 500 divides the reference gray voltages to generate a gray voltage for all gray levels and then selects a data signal among them.

The memory 700 is connected with the signal controller 600 to store gamma data for a gamma curve and then transmits the gamma data to the signal controller 600. The gamma curve is a curve representing luminance or transmittance for a gray of the input image signal (IDAT), and may determine a gray voltage or a reference gray voltage based thereon. The gamma data stored in the memory 700 may include gamma data for two or more different gamma curves. The memory 700 may be included in the signal controller 600 or the gray voltage generator 800.

The signal controller 600 receives an input image signal (IDAT) and an input control signal (ICON) from a graphics controller (not shown) and controls the operations of the gate driver 400 and the data driver 500. The graphics controller receives the image data from the outside and processes the image data to generate and output the input image signal (IDAT) to the signal controller 600. In an exemplary embodiment, the graphics controller performs a frame range control of inserting a middle frame between adjacent frames to reduce a motion blur.

Referring to FIG. 3, the signal controller 600 according to an exemplary embodiment of the present invention includes a frame memory 610 and an image signal processor 620.

The frame memory 610 stores the input image signal (IDAT) input from an outside source (e.g., the graphics controller), and then outputs it to the image signal processor 620. The (n−1)-th (n is a natural number) input image signal (IDAT) is referred to as a previous image signal G(n−1), and the n-th input image signal (IDAT) is referred to a current image signal Gn. The frame memory 610 stores the previous image signal G(n−1). The image signal processor 620 receives the current image signal Gn together with the previous image signal G(n−1) from the frame memory 610 when the current image signal Gn is output. The frame memory 610 may be positioned inside or outside the signal controller 600.

The image signal processor 620 performs an operation on the previous image signal G(n−1) and the current image signal Gn to generate a final correction image signal Gn*.

The image signal processor 620 according to an exemplary embodiment of the present invention includes a comparator 630, a DCC (dynamic capacitance compensation) unit 640, and a TGM (temporal gamma mixing) unit 650.

The comparator 630 compares the previous image signal G(n−1) and the current image signal Gn to generate a flag signal. The flag signal is information for a luminance change condition, and may be added to a lower bit of the previous image signal G(n−1) or the current image signal Gn or may be stored to an additional memory. A detailed example of the flag signal will be described later.

The TGM unit 650 converts the current image signal Gn as one input image signal (IDAT) into a plurality of frames applied with at least two different gamma curves through a doubling and TGM signal processing. The TGM signal processing processes the input image signal to be displayed as the image according to the different gamma curves in a plurality of doubled frames. In an exemplary embodiment, the TGM signal processing is omitted. The image signal input to the TGM unit 650 may be a correction image signal Gn' that is output from the DCC unit 640 or the current image signal Gn without being processed in the DCC unit 640. Also, the flag signal generated in the comparator 630 may be added to the lower bit of the current image signal Gn input to the TGM unit 650. The TGM unit 650 may be connected to a memory 651 storing the input image signal in units of frames. The memory 651 may be positioned inside or outside of the signal controller 600.

A plurality of frames of the doubling and TGM signal processing are referred to as one frame set. Accordingly, a frame frequency to input the data voltage corresponding to the image signal of a plurality of frames that are processed by the doubling and TGM signal processing to the display panel 300 may be double the image frequency at which the input image signal (IDAT) is input. In an exemplary embodiment of the invention, the doubling and TGM signal processing setting two frames as one frame is described, but the invention is not limited thereto.

The image frequency may be 1/n (n is a natural number of 2 or more) of the frame frequency. For example, when the frame frequency is 120 Hz, the image frequency may be 60 Hz, and when the frame frequency is 240 Hz, the image frequency may be 60 Hz, 80 Hz, or 120 Hz. For example, when the input image signal (IDAT) input to the signal controller 600 is the signal processed by the frame rate control that was previously described, the image frequency may be 120 Hz and the frame frequency may be 240 Hz, and when the input image signal (IDAT) is not processed by the frame rate control, the image frequency may be 60 Hz and the frame frequency may be 120 Hz.

Figure 4:
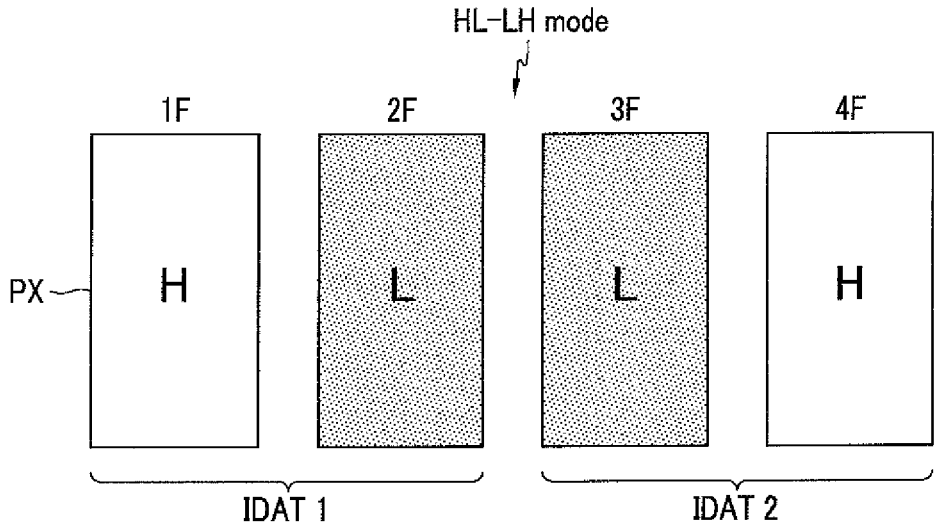
FIG. 4 and FIG. 5 are views of a luminance according to a gamma curve applied to one pixel according to a frame sequence of a liquid crystal display according to an exemplary embodiment of the present invention.
Figure 5:
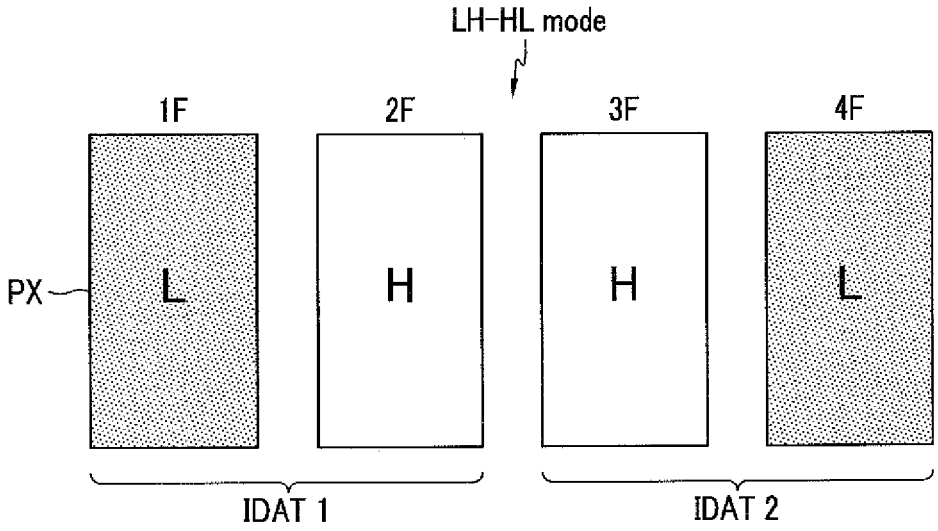
Figure 6:
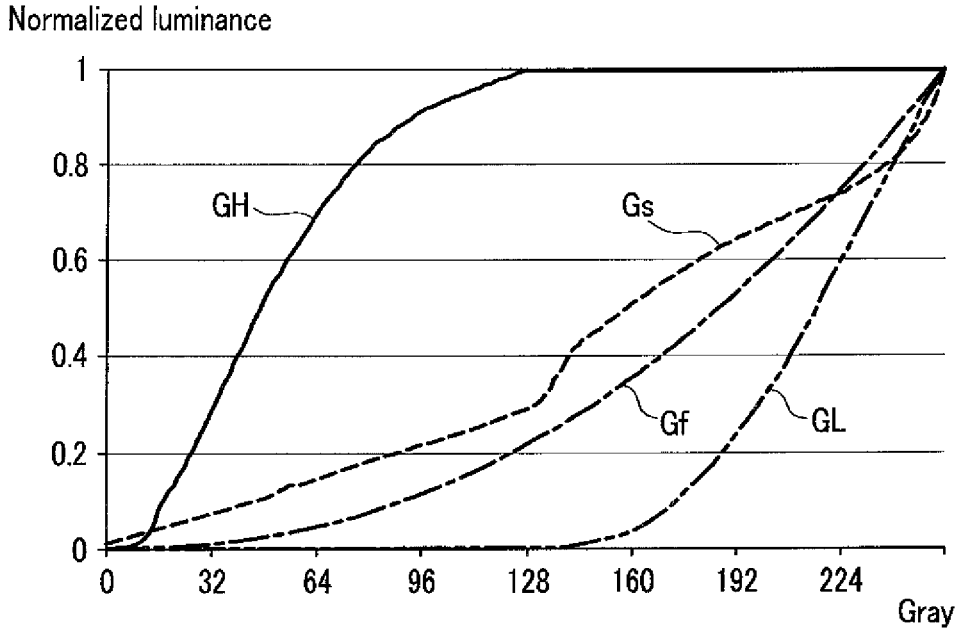
FIG. 6 is a graph of a gamma curve of a liquid crystal display according to an exemplary embodiment of the present invention.

Referring to FIG. 4 and FIG. 5, if the image is displayed by the image signals of two frames included in one frame set, the image according to different gamma curves may be displayed. In detail, in two frames of one frame set, one may display the image (referred to as the first image (H)) according to the first gamma curve GH, and the other may display the image (referred to as the second image (L)) according to the second gamma curve GL. For example, referring to FIG. 6, the gamma data of the liquid crystal display according to an exemplary embodiment of the present invention may include the gamma data for the first gamma curve GH and the second gamma curve GL. Here, the luminance of the image according to the first gamma curve GH may be higher than or equal to the luminance of the image according to the second gamma curve GL. In order to improve side visibility of the display device, the first and second gamma curves may be adjusted so that a synthetic gamma curve in the front of the first and second gamma curves GH and GL coincides with a front gamma curve Gf (for example, a gamma curve having a gamma value of 2.2) which is determined to be most suitable for the display device and a synthetic gamma curve in the side thereof is maximally close to the front gamma curve Gf.

Referring to FIG. 4, when the first image H is displayed in the first frame of one frame set for the input image signal (IDAT1) and the second image L is displayed in the second frame of the one frame set, the second image L is displayed in the first frame of a second frame set for the next input image signal (IDAT2) and the first image H is displayed in the second frame of the second frame set. This TGM mode is referred to as an HL-LH mode.

Referring to FIG. 5, when the second image L is displayed in the first frame of one frame set for the input image signal (IDAT1) and the first image H is displayed in the second frame of the one frame set, the first image H is displayed in the first frame of the second frame set for the next input image signal (IDAT2) and the second image L is displayed in the second frame in the second frame set. This TGM mode is referred to as an LH-HL mode.

According to an exemplary embodiment, when the first image H is displayed in the first frame of one frame set for the input image signal (IDAT1) and the second image L is displayed in the second frame of the one frame set, the first image H is displayed in the first frame of the second frame set for the next input image signal (IDAT2) and the second image L is displayed in the second frame in the second frame set. This TGM mode is referred to as an HL-HL mode.

According to an exemplary embodiment, when the second image L is displayed in the first frame of one frame set for the input image signal (IDAT1) and the first image H is displayed in the second frame of the one frame set, the second image L is displayed in the first frame of the second frame set for the next input image signal (IDAT2) and the first image H is displayed in the second frame in the second frame set. This TGM mode is referred to as an LH-LH mode.

Alternatively, the gamma data may include the gamma data for at least three different gamma curves, and accordingly, the image signals of at least three frames included in one frame set may display the image according to at least three different gamma curves.

For one pixel PX, the TGM modes applied to the input image signals (IDAT) that are temporally adjacent to each other may be the same or different from each other. Also, an application sequence of the TGM mode for each frame may be changed. Also, the same TGM mode may be applied for the continuous frame set and the different TGM modes may be alternately applied. For example, if the HL-LH mode is applied for the previous image signal G(n−1), the LH-HL mode may be applied to the current image signal Gn. In an exemplary embodiment of the invention, the same TGM mode is applied to the input image signals (IDAT) that are temporary adjacent.

Also, the TGM mode applied to one pixel PX and the TGM mode applied to the pixel PX adjacent thereto may be the same or different. For example, when the TGM mode applied to one pixel PX is the HL-HL mode, the TGM mode applied to the adjacent pixel PX may be the LH-LH mode, and in contrast, when the TGM mode applied to one pixel PX is the LH-LH mode, the TGM mode applied to the adjacent pixel PX may be the HL-HL mode.

In an exemplary embodiment, if the image signal of the frame is processed by the doubling and TGM signal processing according to the selected TGM mode, the images according to the different gamma curves are displayed in the consecutive frames such that the combination gamma curve in the side is closest to the front gamma curve, thereby improving the lateral visibility. In an exemplary embodiment, one pixel PX is not divided into two sub-pixels to improve the transmittance. When the HL-LH mode or the LH-HL mode are included in the consecutive frame set, if a display sequence of the first image H and the second image L is reversed, the second image L having the lower luminance is displayed in the consecutive frame such that the slow response speed of the liquid crystal molecules may be compensated in the case of the liquid crystal display. In detail, the response speed (referred to as a decreasing response speed) when the inclination direction of the liquid crystal molecules is changed from the high luminance of the image to the low luminance is obtained over a predetermined level to sufficiently improve the lateral visibility by applying the temporal division driving method according to an exemplary embodiment of the present invention. In two consecutive frames according to an exemplary embodiment of the present invention, the second image L having the low luminance is displayed such that the low gray is sufficiently displayed in the temporal division driving thereby further improving the lateral visibility. Likewise, the first image H having the high luminance may be displayed in the consecutive frame. Accordingly, when displaying the image of the high luminance after displaying the image of the low luminance, the response speed of the liquid crystal molecule is compensated, thereby displaying a sufficiently high gray.

The DCC unit 640 compares the previous image signal G(n−1) and the current image signal Gn according to the DCC (dynamic capacitance compensation) method to improve the response speed of the liquid crystal to compensate the current image signal Gn according to a predetermined condition when the grays of two image signals G(n−1) and Gn are different from one another. In an exemplary embodiment, the current image signal Gn input to the DCC unit 640 is the image signal that is processed by the doubling and TGM signal processing in the TGM unit 650 or the current image signal Gn before the doubling and TGM signal processing in the TGM unit 650. In an exemplary embodiment, the flag signal generated in the comparator 630 is added to the lower bit of the current image signal Gn or the previous image signal G(n−1) input to the DCC unit 640. On the other hand, if the previous image signal G(n−1) and the current image signal Gn are equal to each other, the current image signal Gn may be output as it is. For example, if the current image signal Gn and the previous image signal G(n−1) input to the DCC unit 640 are identical, the DCC unit 640 may output the current image signal Gn or a signal resulting from performing the doubling and TGM processing on the current image signal Gn.

Figure 7:
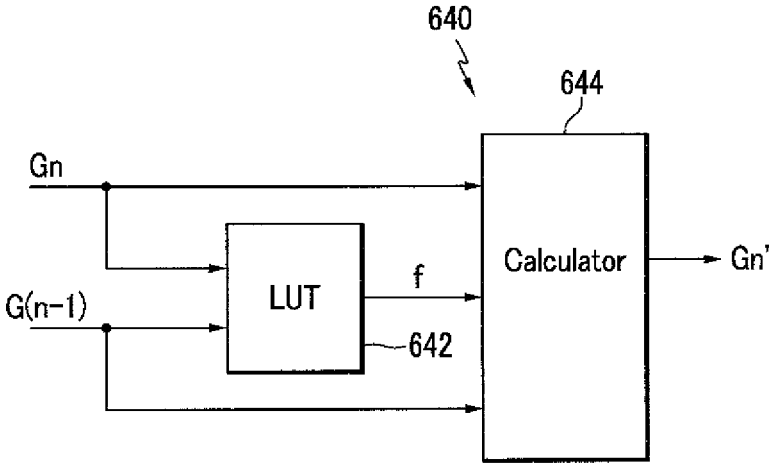
FIG. 7 is a block diagram of a DCC unit of a liquid crystal display according to an exemplary embodiment of the present invention.

Referring to FIG. 7, the DCC unit 640 according to an exemplary embodiment of the present invention includes a lookup table 642 and a calculator 644 connected thereto.

The lookup table 642 stores correction reference data f for a pair (G(n−1), G(n)) of the previous image signal G(n−1) and the current image signal Gn. To reduce the capacity of the lookup table 642, the lookup table 642 may store the correction image signal Gn' determined for a limited number of pairs (e.g., G(n−1), G(n)) of the previous image signal G(n−1) and the current image signal Gn as the correction reference data f. For example, the lookup table 642 may determine and store the correction reference data f by using a high bit of the previous image signal G(n−1) and the current image signal Gn. The correction reference data f stored to the lookup table 642 may be determined by a measuring result, and is a value that is generated by applying the DCC to the current image signal Gn based on the previous image signal G(n−1) and the current image signal Gn.

Figure 8:
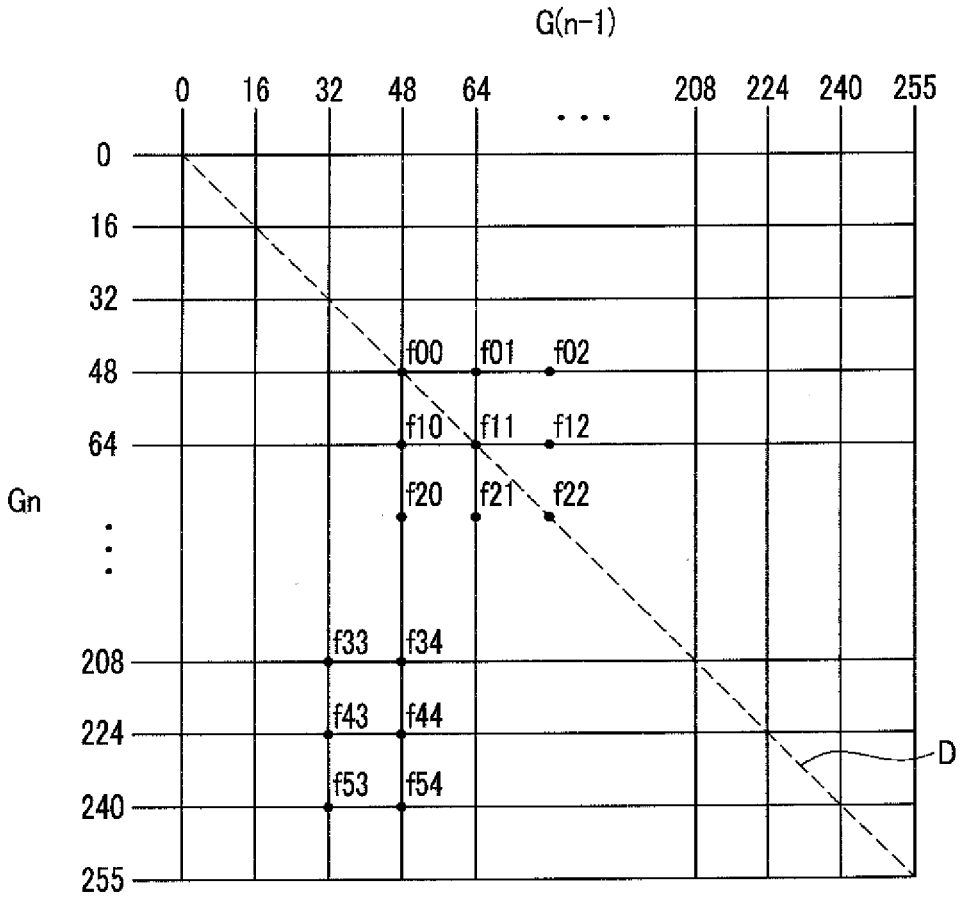
FIG. 8 is a view of one example of the lookup table (LUT) shown in FIG. 7, FIG. 9 and FIG. 10 are views showing a method for calculating a correction image signal through a DCC type in a liquid crystal display according to an exemplary embodiment of the present invention.

For example, FIG. 8 shows the lookup table 642 including 17×17 blocks configured by using only the high bit of 4 bits in a case of the 8-bit input image signal (IDAT). Points existing on the boundary of the block are points where the lower bit of the previous image signal G(n−1) or the current image signal Gn is 0. The high bits of the points existing in each block for the previous image signal G(n−1) and current image signal Gn are the same, and the points that are positioned on the left edge and the upper edge also have the high bit like the points inside the block. However, the high bits of the points existing on the right edge and the lower edge are different from the high bits of the points inside the block.

In an exemplary embodiment, the calculator 644 obtains the correction image signal Gn' for the combination of the previous image signal G(n−1) and the current image signal Gn that are not stored to the lookup table 642 by using interpolation through the correction reference data f from the lookup table 642, and the previous image signal G(n−1) and the current image signal Gn. The processing obtaining the correction image signal Gn' by the DCC processing may be referred to as a first correction.

To obtain the correction image signal Gn', different interpolations may be used for the blocks including a diagonal D of the lookup table 642, that is, the blocks where the high bits of the previous image signal G(n−1) and the current image signal Gn are the same and the blocks where the high bits of the previous image signal G(n−1) and the current image signal Gn are different. When applying the interpolation for a point of any block, the interpolation may be applied with reference to the correction reference data f of four apexes defining the block.

Figure 9:
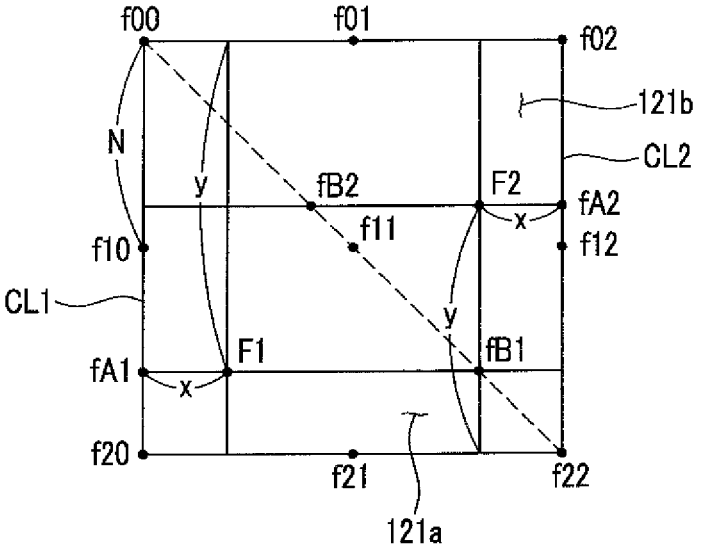

Referring to FIG. 9 as well as FIG. 8, if a method of obtaining the correction image signal Gn' in a low gray difference block is described, the low gray difference block where the high bit of the current image signal Gn and the high bit of the previous image signal G(n−1) are the same may be defined by the square block having the apexes of the first, second, third, fourth, fifth, sixth, seventh, eighth, and ninth reference data (f00, f10, f20, f01, f11, f12, f02, f21, and f22). The low gray difference block may include a lower triangular block 121*a* defined by the first, second, third, fifth, sixth, and ninth reference data (f00, f10, f20, f11, f12, and f22) and an upper triangular block 121*b* defined by the first, fourth, fifth, seventh, eighth, and the ninth reference data (f00, f01, f11, f02, f21, and f22). The lower triangular block 121*a* is positioned under the diagonal (D), and the current image signal Gn may be defined by a rising part larger than the previous image signal G(n−1). The upper triangular block 121*b* is positioned on the diagonal (D), and the current image signal Gn may be defined by a falling part smaller than the previous image signal G(n−1).

Firstly, one example of a calculating process of the first interpolation F1 as the correction image signal Gn' in the lower triangular block 121*a* will be described.

The first reference equation fA1 made of a second order formula is calculated based on the first to third reference data f00, f10, and f20 existing on the first column line CL1 of the lower triangular block 121*a*, and a column component of the correction image signal Gn' may be calculated by the first reference equation fA1.

In an exemplary embodiment, the first reference equation fA1 is defined by Equation 1.

$$fA1 = a1y^2 + b1y + c1 \quad \text{(Equation 1)}$$

$$a1 = \frac{1}{4N}(f20 - 2f10 + f00)$$

-continued $$b1 = \frac{1}{4N}(-f20 + 4f10 - 3f00) - \frac{y0}{2N^2}(f20 - 2f10 + f00)$$

$$c1 = f00 - a1y0^2 - b1y0$$

Here, N is a block interval, y is a value of the lower bit of the current image signal Gn divided by the block interval N, and y0 is a y value calculated by the first reference data f00 in the first reference equation fA1.

Next, the second reference equation fB1 made of a first order formula is calculated based on the first and fifth reference data f00 and f11 existing on the diagonal (D) of the lower triangular block 121*a*. In an exemplary embodiment, the second reference equation fB1 is defined by Equation 2.

$$fB1 = f00 + y \quad \text{(Equation 2)}$$

The first interpolation F1 may be defined by a proportional expression of the first and second reference equations fA1 and fB1. A proportional expression like Equation 3 for the lower triangular block 121*a* may be established.

$$x:y = (F1 - fA1):(fB1 - fA1) \quad \text{(Equation 3)}$$

Accordingly, the first interpolation F1 may be defined by Equation 4.

$$F1 = (1 - b1)x + b1y - a1xy + (f00 - c1)\frac{x}{y} + a1y^2 + c1 \quad \text{(Equation 4)}$$

Here, x is a value of the lower bit of the previous image signal G(n−1) divided by the block interval N.

Resultantly, the calculator 644 may calculate the correction image signal Gn' by using the first interpolation F1 when the current image signal Gn is larger than the previous image signal G(n−1).

Next, one example of a calculating a second first interpolation F2 as the correction image signal Gn' in the upper triangular block 121*b* will be described.

The third reference equation fA2 made of the second order formula is calculated based on the seventh to ninth reference data f02, f12, and f22 existing on the second column line CL2 of the upper triangular block 121*b*, and the column component of the correction image signal Gn' may be calculated by using the third reference equation fA2. In an exemplary embodiment, the third reference equation fA2 is defined by Equation 5.

$$fA2 = a2y^2 + b2y + c2 \quad \text{(Equation 5)}$$

$$a2 = \frac{1}{4N}(f02 - 2f12 + f22)$$

$$b2 = \frac{1}{4N}(-f02 + 4f12 - 3f22) - \frac{y2}{2N^2}(f02 - 2f12 + f22)$$

$$c2 = f22 - a2y2^2 - b2y2$$

Here, y2 is the y value calculated by the ninth reference data f22 in the third reference equation fA2.

Next, the fourth reference equation fB2 made of the first order formula is calculated based on the fifth and ninth reference data f11 and f22 existing on the diagonal (D) of the upper triangular block 121*b*. In an exemplary embodiment, the fourth reference equation fB2 is defined like Equation 6.

$$fB2=f22+y \quad \text{(Equation 6)}$$

The second interpolation F2 may be defined by a proportional expression of the third and fourth reference equations fA1 and fB1. The proportional expression like Equation 3 for the upper triangular block 121*b* may be established.

$$x:y=(fA2-F2):(fA2-fB2) \quad \text{(Equation 7)}$$

Accordingly, the second interpolation F2 may be defined like Equation 8.

$$F2=(1-b2)x+b2y-a2xy+(f22-c2)\frac{x}{y}+a2y^2+c2 \quad \text{(Equation 8)}$$

Resultantly, the calculator 644 may calculate the correction image signal Gn' by using the second interpolation F2 when the current image signal Gn is smaller than the previous image signal G(n−1).

As described above, for the low gray difference block including the diagonal (D), the correction image signal Gn' may be calculated by using Equation 4 and Equation 8 and thus the current image signal Gn may be corrected more precisely. That is, for two blocks 121*a* and 121*b*, the current image signal Gn may be corrected more precisely by respectively applying the first and second interpolations F1 and F2 although the slopes of the lookup table 642 in the lower triangular block 121*a* and the upper triangular block 121*b* are different according to the liquid crystal characteristic.

Figure 10:
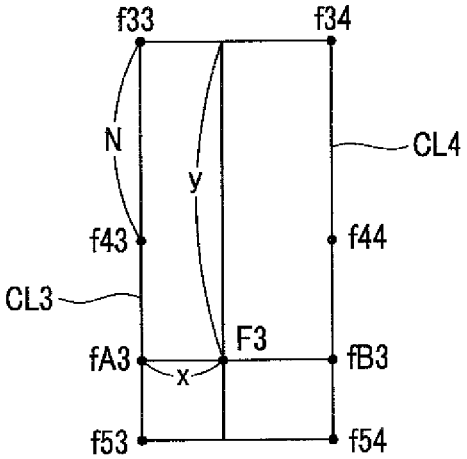

Referring to FIG. 10 as well as FIG. 8, if a method obtaining the correction image signal Gn' in a high gray difference block is described, the high gray difference block where the high bit of the current image signal Gn and the high bit of the previous image signal G(n−1) are different may be defined by the square block having the apexes of the tenth, the eleventh, the twelfth, the thirteenth, the fourteenth, and the fifteenth reference data (f33, f43, f53, f34, f44, and f54). In the high gray difference block, the correction image signal Gn' may be calculated by the third interpolation F3.

A calculation process of the third interpolation F3 will be described.

The fifth reference equation fA3 made of the second order formula is calculated based on the tenth to twelfth reference data f33, f43, and f53 existing on the third column line CL3 of the high gray difference block, and the column component of the correction image signal Gn' may be calculated by the fifth reference equation fA3.

In an exemplary embodiment, the fifth reference equation fA3 is defined by Equation 9.

$$fA3=a3y^2+b3y+c3 \quad \text{(Equation 9)}$$

$$a3=\frac{1}{4N}(f53-2f43+f33)$$

$$b3=\frac{1}{4N}(-f53+4f43-3f33)-\frac{y3}{2N^2}(f53-2f43+f33)$$

$$c3=f33-a3y3-b3y3$$

Here, y3 is the y value calculated by the tenth reference data f33 in the fifth reference equation fA3.

Next, the sixth reference equation fB3 made of the second order expression is calculated based on the thirteenth to fifteenth reference data f34, f44, and f54 existing on the fourth column line CL4 of the high gray difference block, and the column component of the correction image signal Gn' may be calculated by the sixth reference equation fB3. The sixth reference equation fB3 may be defined by Equation 10.

$$fB3=a'3y^2+b'3y+c'3 \quad \text{(Equation 10)}$$

$$a'3=\frac{1}{4N}(f54-2f44+f34)$$

$$b'3=\frac{1}{4N}(-f54+4f44-3f34)-\frac{y4}{2N^2}(f54-2f44+f34)$$

$$c'3=f34-a'3y4^2-b'3y4$$

Here, y4 is the y value calculated by the thirteenth reference data f34 in the sixth reference equation fB3.

The third interpolation F3 may be defined by a proportional expression of Equation 11 of the fifth and sixth reference equations fA3 and fB3.

$$N:x=(fB3-fA3):(F3-fA3) \quad \text{(Equation 11)}$$

Accordingly, the third interpolation F3 may be defined by Equation 12.

$$F3=\left(\frac{a'3}{N}x-\frac{a3}{N}x+a3\right)y^2+\left(\frac{b'3}{N}x-\frac{b3}{N}x+b3\right)y+\frac{c'3+c3}{N}x+c3 \quad \text{(Equation 12)}$$

As described above, for the high gray difference block, the correction image signal Gn' is calculated by using the third interpolation F3 calculated by the fifth and sixth reference equations fA3 and fB3 made of the second order expression, and the current image signal Gn may be exactly corrected.

Also, the DCC unit 640 may generate the correction image signal Gn' according to the first correction by various methods.

The DCC unit 640 may further includes a post processor (not shown) post-processing (referred to as secondary correction) the image signal of a portion among a plurality of frames of the correction image signal Gn' resulting from the doubling and TGM signal processing in the TGM unit 650. The image signal for the post-processing may be the correction image signal Gn' that is firstly corrected in the DCC unit 640 after the doubling and TGM signal processing in the TGM unit 650, and in contrast, it may be the image signal of which the correction image signal Gn' is firstly generated by the first correction in the DCC unit 640 and then is processed by the doubling and TGM signal processing in the TGM unit 650. For example, the post-processing may operate on a signal derived from performing a doubling and TGM processing followed by a DCC or a signal derived from performing a DCC followed by the doubling and TGM processing. The DCC unit 640 may multiply a predetermined weight value by the image signal of a portion among the plurality of frames of the correction image signal Gn' that is processed by the doubling and TGM signal in the post-processing, or may output the current image signal Gn before the first correction. The weight value may be stored to a separate memory inside the signal controller 600 with a lookup table form. The frame post-processed in the post processor may be the second frame of two frames that is processed by the doubling and TGM signal processing, or a frame of more than the second frame among a plurality of frames that are processed by the doubling and TGM signal processing.

Next, a driving method including an image signal processing method of a liquid crystal display according to an exemplary embodiment of the present invention will be described with reference to the above-described drawings.

The signal controller 600 receives the input image signal (IDAT) and an input control signal (ICON) controlling the display thereof from the outside. The input image signal (IDAT) includes the luminance information of each pixel PX, and the luminance has grays that correspond to a defined number. The input control signal (ICON) may include at least one of a vertical synchronizing signal, a horizontal synchronizing signal, a main clock signal, a data enable signal, etc.

The signal controller 600 stores a first input image signal (IDAT) that is input to the frame memory 610 as the previous image signal G(n−1). Next, if a second input image signal (IDAT) is input, the second input image signal (IDAT) is output to the image signal processor 620 as the current image signal Gn along with the previous image signal G(n−1) that is stored to the frame memory 610.

The image signal processor 620 processes the current image signal Gn through the above-described comparator 630, DCC unit 640, and TGM unit 650 to generate a final correction image signal Gn*. The process sequence in the comparator 630, the DCC unit 640, and the TGM unit 650 may be variously changed.

The signal controller 600 generates a gate control signal CONT1, a data control signal CONT2, and a gamma control signal CONT3. The signal controller 600 outputs the gate control signal CONT1 to the gate driver 400, the data control signal CONT2 and the final correction image signal Gn* as the output image signal DAT to the data driver 500, and the gamma control signal CONT3 to the gray voltage generator 800. The gamma control signal CONT3 may include the gamma data stored to the memory 700. The gamma data may be directly output to the gray voltage generator 800. Also, the memory 700 may be omitted.

The gray voltage generator 800 generates gray voltages or a finite number of reference gray voltages according to the gamma control signal CONT3 to transmit the gray voltages or the reference gray voltages to the data driver 500. The gray voltage may be respectively provided by a set for the different gamma curves. For example, the gray voltage may depend on the gamma curve shown in FIG. 6. In this case, the TGM signal processing changing the gray of the image signal input in the TGM unit 650 may be omitted, and the gray voltage of the different set may be applied to a plurality of doubled frames.

The data driver 500 receives the output image data DAT for the pixels PX of one row depending on the data control signal CONT2, selects the gray voltage corresponding to each output image data DAT to convert the output image data DAT into the analog data voltage (Vd), and then applies the converted analog data voltage to the corresponding data lines D1-Dm. When a number of frames processed by the doubling and TGM signal processing in the TGM unit 650 is 2, the frame frequency at which the data driver 500 outputs the data voltage (Vd) to the data line (D1-Dm) may be two times the input frequency of the input image signal (IDAT).

Alternatively, a plurality of gray voltages may be generated in the data driver 500.

According to an exemplary embodiment of the present invention, the gray voltage generator 800 or the data driver 500 only generate one set of gray voltages. In this case, the above described TGM unit 650 processes the image signal of a plurality of doubled frames by the TGM signal, and converts them into an analog data voltage (Vd) through the gray voltage of the same set to display an image according to the different gamma curves.

The gate driver 400 applies the gate-on voltage Von to the gate lines GL1-GLn according to the gate control signal CONT1 to turn on the switching element connected to the gate lines G1-Gn. Thus, the data signal applied to the data lines D1-Dm is applied to the corresponding pixel PX through the turned-on switching element. If the data voltage (Vd) is applied to the pixel PX, the pixel PX displays the luminance corresponding to the data voltage (Vd).

While the process is repeated by setting 1 horizontal period (written as "1H") as a unit, gate-on voltages Von are sequentially applied to all of the gate lines GL1-GLi and data voltages are applied to all of the pixels PX, thereby displaying images of one frame. The horizontal period may be the same as one period of a horizontal synchronizing signal Hsync and a data enable signal DE.

Figure 20:
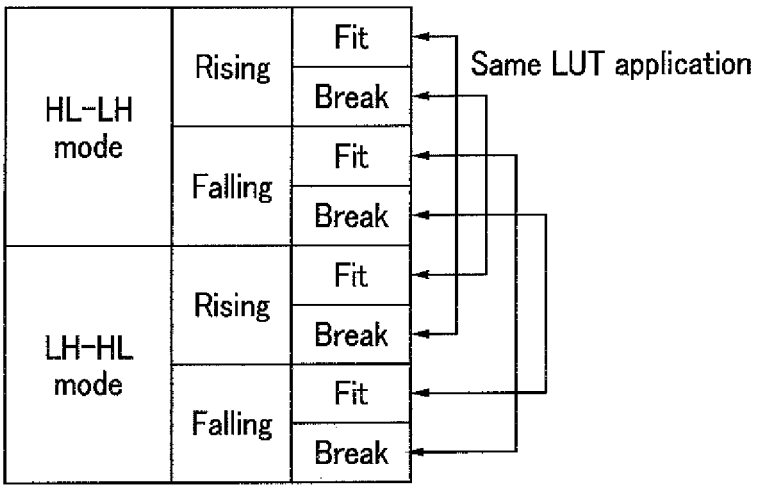
FIG. 20 is a table of a TGM mode and a luminance change condition in a liquid crystal display according to an exemplary embodiment of the present invention.

FIG. 11 to FIG. 18 are graphs showing an input image signal, a target image for each frame, and a luminance change according to a frame in a liquid crystal display according to an exemplary embodiment of the present invention, FIG. 19 is a table of one example of a weight value applied to post-processing in a liquid crystal display according to an exemplary embodiment of the present invention, and FIG. 20 is a table of a TGM mode and a luminance change condition in a liquid crystal display according to an exemplary embodiment of the present invention.

In an exemplary embodiment of the invention, a case where the frame frequency is two times the image frequency, that is, in a case where one input image signal (IDAT) is converted into two frames by the doubling and TGM signal processing in the TGM unit 650, will be described as an example. In an exemplary embodiment, the input image signal (IDAT) is the image signal processed by the frame rate control before the input to the signal controller 600. FIG. 11 to FIG. 14 show a case of the HL-LH mode among the TGM modes, and FIG. 15 to FIG. 18 show a case of the LH-HL mode among the TGM modes.

Figure 11:
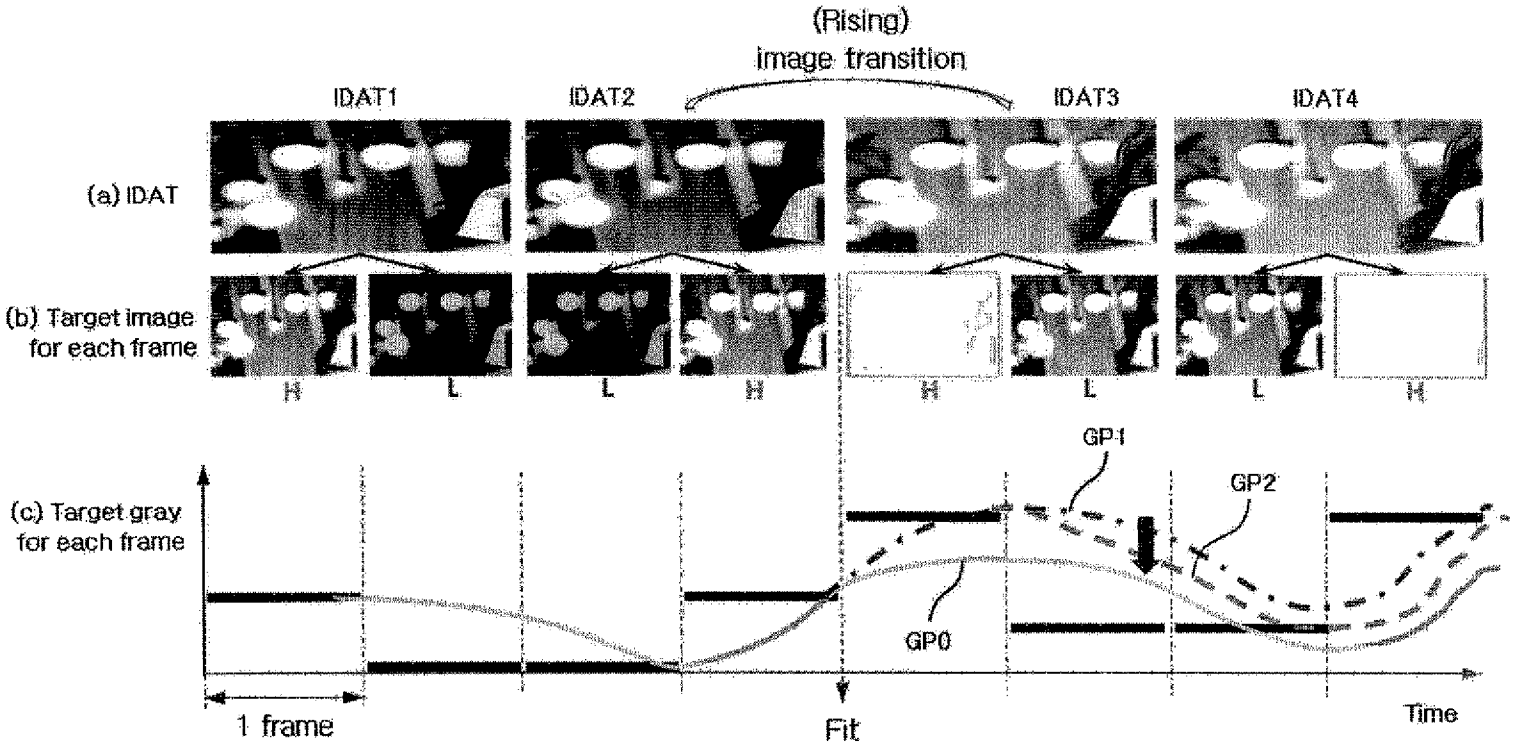
FIG. 11 to FIG. 18 are graphs showing an input image signal, a target image for each frame, and a luminance change according to a frame in a liquid crystal display according to an exemplary embodiment of the present invention.

Referring to FIG. 11 (*a*) and FIG. 11 (*b*), the four continuously input image signals (IDAT1-IDAT4) that are sequentially input to the signal controller 600 are processed with the doubling and TGM signal processing in the TGM unit 650, and thereby the HL-LH mode is sequentially applied. Also, a luminance change (e.g., an image transition) is generated between the second input image signal (IDAT2) and the third input image signal (IDAT3) among the four input image signals (IDAT1-IDAT4). In the exemplary embodiment shown in FIG. 11, the gray of the third input image signal (IDAT3) is larger than the gray of the second input image signal (IDAT2). An increase of the luminance among consecutive image signals may be referred to as a rising condition (Rising). Also, in the present exemplary embodiment, the HL-LH mode is applied once for the first input image signal (IDAT1) and the second input image signal (IDAT2) such that the luminance is changed after one TGM mode is finished. This condition is referred to as a fit condition (Fit).

FIG. 11 (*c*) shows a constant target gray for each frame of the target image that is processed with the doubling and TGM signal processing shown in FIG. 11 (*b*) and luminance changes GP0, GP1, and GP2 of the image. When the HL-LH mode is only applied in the TGM unit 650 through the doubling and TOM signal processing of the image signal and the image is output without the processing in the DCC unit 640, like the curve GP0 before the correction of FIG. 11 (*c*), the liquid crystal cannot quickly produce the luminance change of the third input image signal (IDAT3) such that the increased luminance of the third input image signal (IDAT3) is not sufficiently expressed.

In contrast, as described above, when outputting the image as the correction image signal that is processed by the first correction in the DCC unit 640, the image as the correction image signal Gn' having a larger gray than the original third input image signal (IDAT3) is output such that the increased luminance of the third input image signal (IDAT3) is sufficiently expressed like the first correction curve GP1 of FIG. 11 (*c*). In the first frame displaying the first image (H) among the frames that are processed by the doubling and TGM signal of the third input image signal (IDAT3), the slope of the first correction curve GP1 is different from the slope of the curve GP0 before the correction.

However, in this case, the first correction processing of the DCC unit 640 is also applied to the second frame displaying the second image (L) of the low luminance among the frames that are processed with the doubling and TGM signal processing of the third input image signal (IDAT3) such that the second image (L) of a sufficiently low luminance is not displayed as shown in the first correction curve GP1. Accordingly, the difference between the luminance of the image and the target gray is largely increased in the second frame displaying the second image (L) of the low luminance among the frames that are processed with the doubling and TGM signal processing of the third input image signal (IDAT3). However, according to an exemplary embodiment of the present invention, the DCC unit 640 of the signal controller 600 outputs the image signal before the first correction as the final correction image signal Gn*, multiples a predetermined weight value W(g) by the correction image signal Gn' that is firstly corrected and outputs it as the final correction image signal Gn*, or applies the post-processing vicariously outputting the image signal Gn before the first correction in the second frame among the frames that are processed with the doubling and TGM signal processing of the third input image signal (IDAT3) such that the image of a sufficiently low luminance close to the target gray is displayed in the second frame among the frames that are processed with the doubling and TGM signal processing of the third input image signal (IDAT3) like the secondary correction curve GP2 of FIG. 11 (*c*).

In an exemplary embodiment, the weight value (W(g) used for the post-processing has a value equal to or more than 0 and equal to or less than 1, as shown in FIG. 19.

Figure 12:
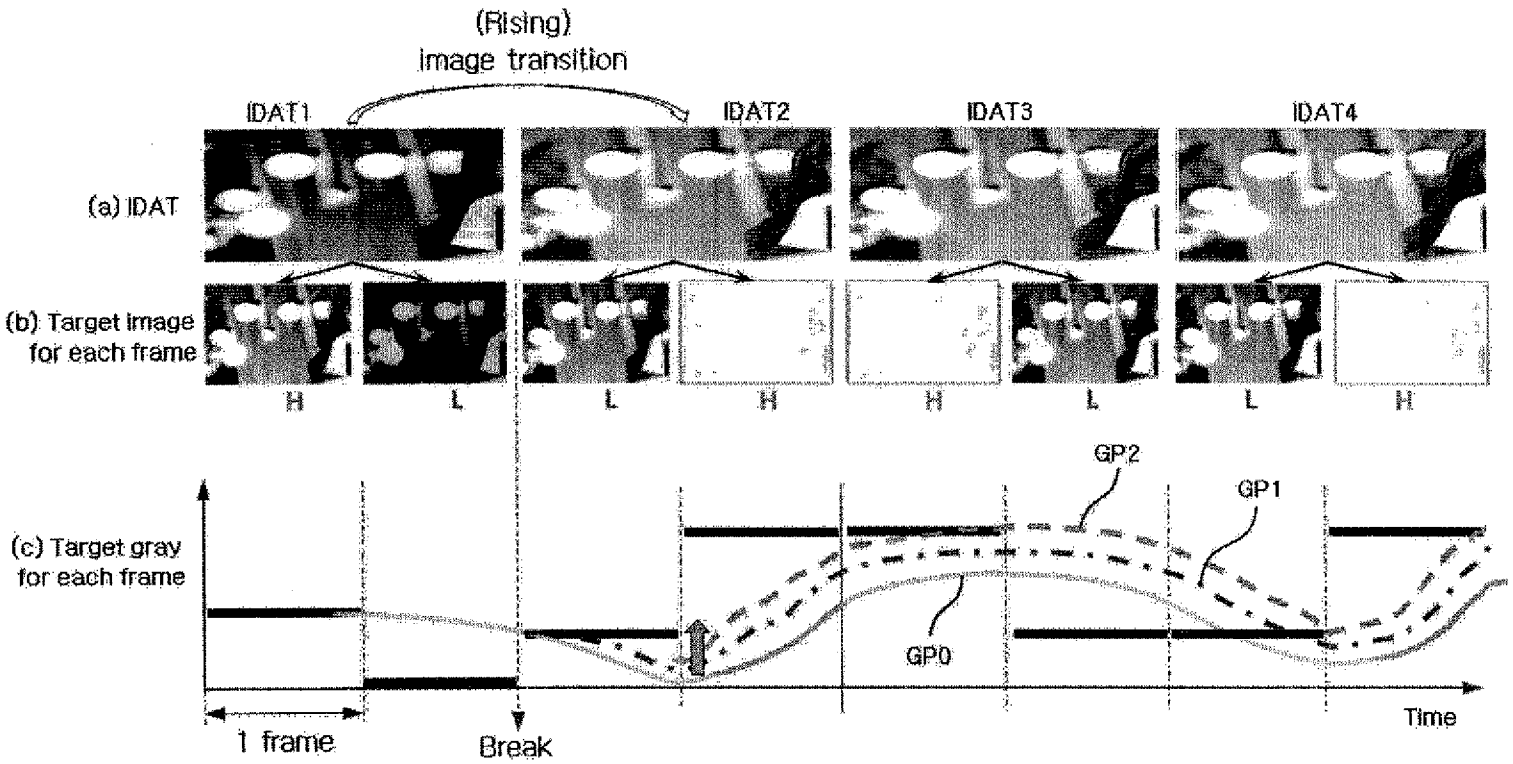

Next, referring to FIG. 12 (*a*) and FIG. 12 (*b*), the four continuously input image signals (IDAT1-IDAT4) that are sequentially input to the signal controller 600 are processed with the doubling and TGM signal processing in the TGM unit 650, and thereby the HL-LH mode is sequentially applied. Also, the luminance change (e.g., an image transition) is generated between the first input image signal (IDAT1) and the second input image signal (IDAT2) among the four input image signals (IDAT1-IDAT4). The exemplary embodiment shown in FIG. 12 provides the rising condition (Rising) in which a gray of the second input image signal (IDAT2) is larger than the gray of the first input image signal (IDAT1). Also, in the present exemplary embodiment, for the first input image signal (IDAT1) and the second input image signal (IDAT2), the luminance is changed depending on the way that the HL-LH mode is applied. This condition is referred to a break condition (Break).

FIG. 12 (*c*) shows a constant target gray for each frame of the target image that is processed with the doubling and TGM signal processing shown in FIG. 12 (*b*) and luminance changes GP0, GP1, and GP2 of the image. When the HL-LH mode is only applied in the TGM unit 650 through the doubling and TGM signal processing of the image signal and the image is output without the processing in the DCC unit 640, like the curve GP0 before the correction of FIG. 12 (*c*), the liquid crystal cannot quickly perform the luminance change of the second input image signal (IDAT2) such that the increased luminance of the second input image signal (IDAT2) is not sufficiently expressed.

In contrast, as described above, when outputting the image as the correction image signal Gn' that is processed by the first correction in the DCC unit 640, the image as the correction image signal Gn' having a larger gray than the original second input image signal (IDAT2) is output such that the increased luminance of the second input image signal (IDAT2) may be sufficiently expressed like the first correction curve GP1 of FIG. 12 (*c*). In the first frame displaying the second image (L) among the frames that are processed by the doubling and TGM signal processing of the second input image signal (IDAT2), the slope of the first correction curve GP1 is different from the slope of the curve GP0 before the correction.

However, in this case, the first correction processing of the DCC unit 640 is also applied to the second frame displaying the first image (H) of the high luminance among the frames that are processed with the doubling and TGM signal processing of the second input image signal (IDAT2), but the first image (H) having the sufficiently high luminance may not be displayed as shown in the first correction curve GP1. Accordingly, the difference between the luminance of the image and the target gray is largely increased in the second frame displaying the first image (H) among the frames that are processed with the doubling and TGM signal processing of the second input image signal (IDAT2). However, according to an exemplary embodiment of the present invention, the DCC unit 640 of the signal controller 600 multiplies the predetermined weight value (W(g)) by the correction image signal that is firstly corrected or applies the post-processing vicariously outputting the current image signal Gn before the first correction as the final correction image signal Gn* in the second frame among the frames that are processed with the doubling and TGM signal processing of the second input image signal (IDAT2) such that the image of the sufficiently high luminance close to the target gray may be displayed in the second frame among the frames that are processed with the doubling and TGM signal processing of the second input image signal (IDAT2) like the secondary correction curve GP2 of FIG. 12 (*c*).

In an exemplary embodiment, the weight value (W(g)) used for the post-processing has a value equal to or more than 1, as shown in FIG. 19.

Figure 13:
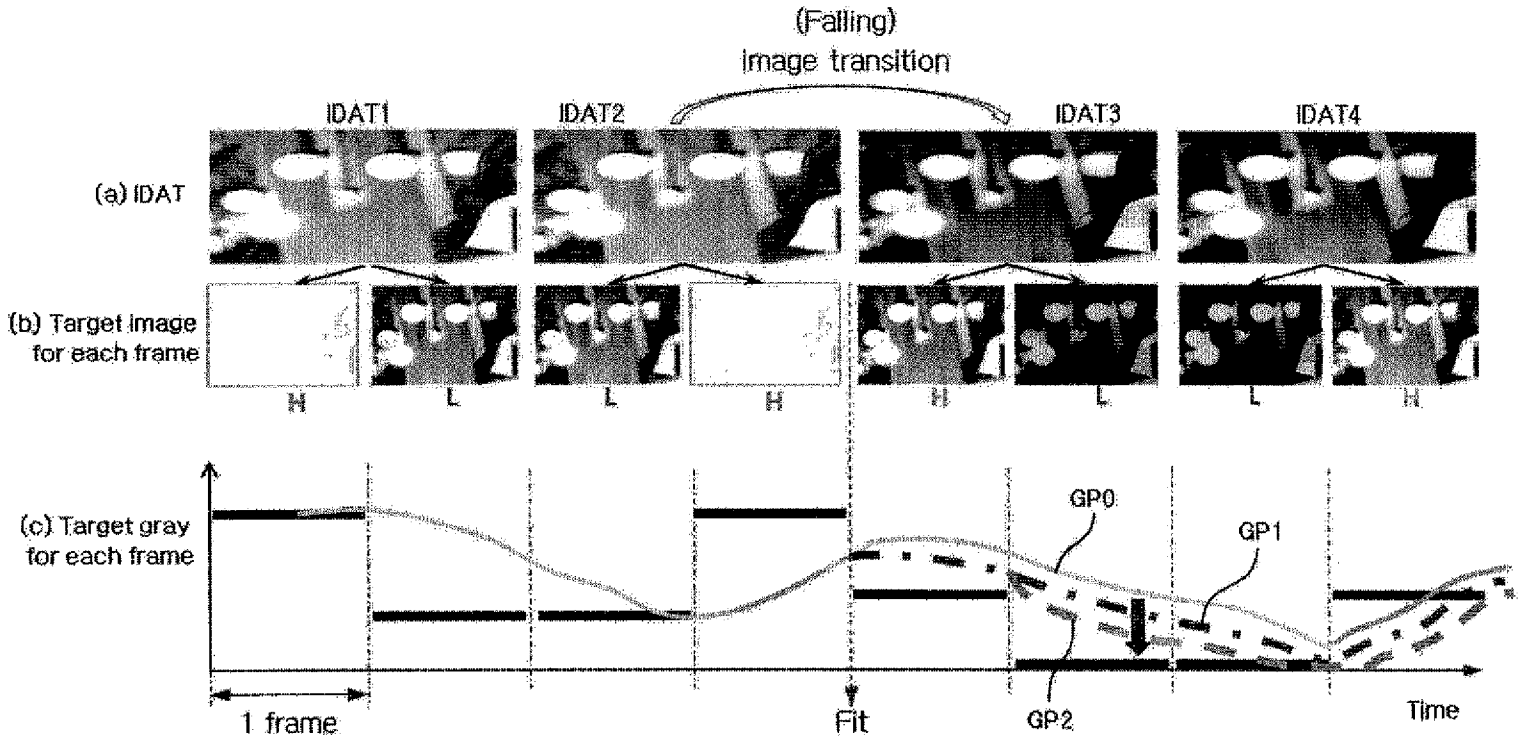

Next, referring to FIG. 13 (*a*) and FIG. 13 (*b*), the four continuously input image signals (IDAT1-IDAT4) that are sequentially input to the signal controller 600 are processed with the doubling and TGM signal processing in the TGM unit 650 such that the HL-LH mode is sequentially applied. Also, the luminance change is generated between the second input image signal (IDAT2) and the third input image signal (IDAT3) among the four input image signals (IDAT1-IDAT4). The exemplary embodiment shown in FIG. 13 shows the falling condition (Falling) in which the gray of the third input image signal (IDAT3) is smaller than the gray of the second input image signal (IDAT2). Also, in the present exemplary embodiment, the HL-LH mode is applied for the first input image signal (IDAT1) and the second input image signal (IDAT2) once such that the fit condition (Fit) in which the luminance is changed after one TGM mode is finished is applied.

FIG. 13 (*c*) shows the constant target gray for each frame of the target image that is performed with the doubling and TGM signal processing shown in FIG. 13 (*b*) and the luminance changes GP0, GP1, and GP2 of the image. When the HL-LH mode is only applied in the TGM unit 650 through the doubling and TGM signal processing of the image signal and the image is output without the processing in the DCC unit 640, like the curve GP0 before the correction of FIG. 13 (*c*), the liquid crystal cannot quickly form the luminance change of the third input image signal (IDAT3) such that the decreased luminance of the third input image signal (IDAT3) is not sufficiently expressed.

In contrast, as described above, when outputting the image as the correction image signal that is processed by the first correction in the DCC unit 640, the image as the correction image signal Gn' having a smaller gray than the original third input image signal (IDAT3) is output such that the decreased luminance of the third input image signal (IDAT3) may be sufficiently expressed like the first correction curve GP1 of FIG. 13 (*c*). In the first frame displaying the first image (H) among the frames that are processed by the doubling and TGM signal processing of the third input image signal (IDAT3), the slope of the first correction curve GP1 is different from the slope of the curve GP0 before the correction.

However, in this case, the first correction processing of the DCC unit 640 is also applied to the second frame displaying the second image (L) of the low luminance among the frames that are processed with the doubling and TGM signal processing of the third input image signal (IDAT3), but the second image (L) having the sufficiently low luminance may not be displayed as shown in the first correction curve GP1. Accordingly, the difference between the luminance of the image and the target gray is largely increased in the second frame displaying the second image (L) among the frames that are processed with the doubling and TGM signal processing of the third input image signal (IDAT3). However, according to an exemplary embodiment of the present invention, the DCC unit 640 of the signal controller 600 multiplies the predetermined weight value (W(g)) by the correction image signal that is firstly corrected or applies the post-processing vicariously outputting the current image signal Gn before the first correction as the final correction image signal Gn* in the second frame among the frames that are processed with the doubling and TGM signal processing of the third input image signal (IDAT3) such that the image of the sufficiently low luminance close to the target gray may be displayed in the second frame among the frames that are processed with the doubling and TGM signal processing of the third input image signal (IDAT3) like the secondary correction curve GP2 of FIG. 13 (*c*).

In an exemplary embodiment, the weight value (W(g)) used for the post-processing has a value equal to or more than 1, as shown in FIG. 19.

Figure 14:
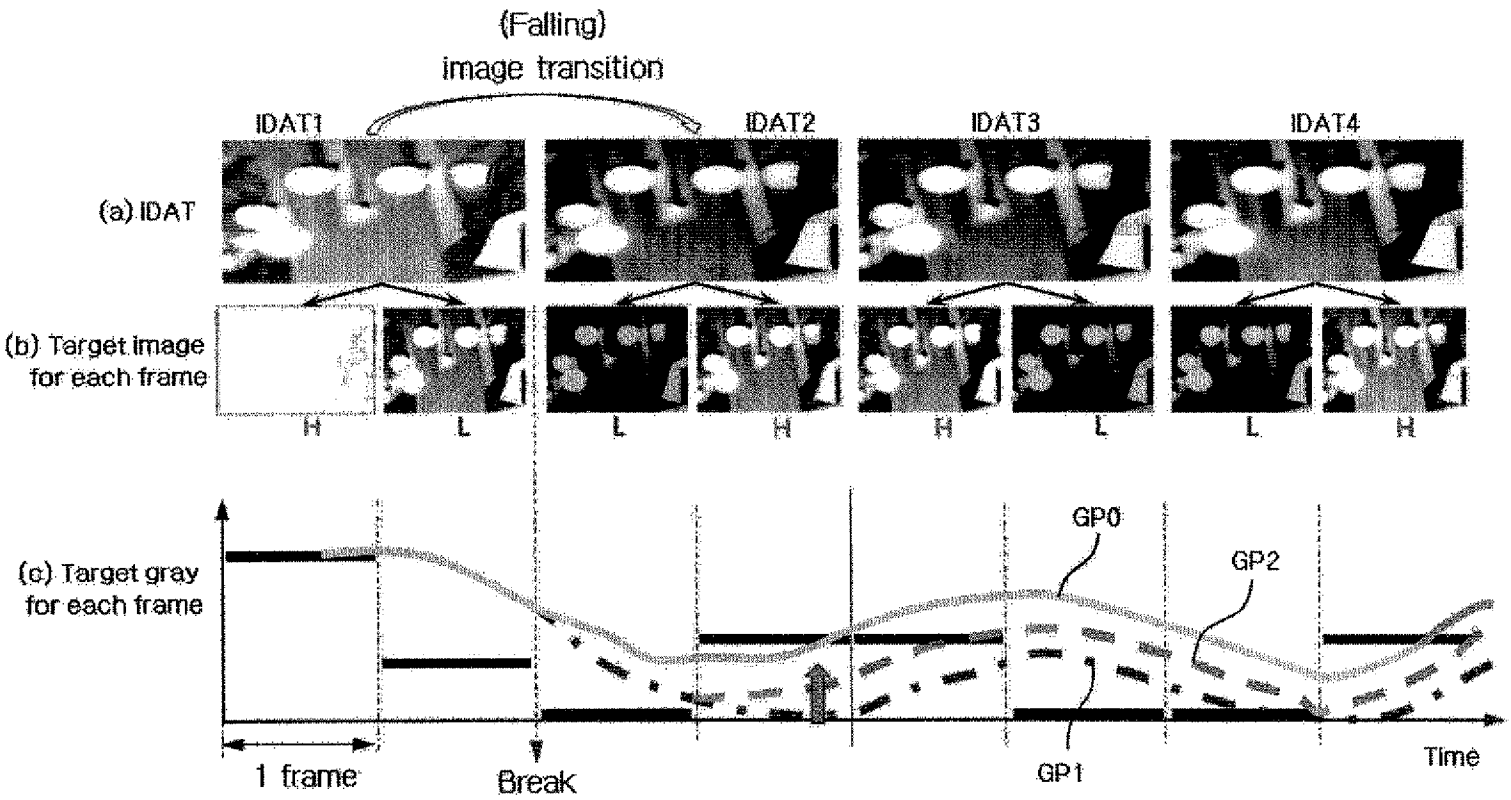

Next, referring to FIG. 14 (*a*) and FIG. 14 (*b*), the four continuously input image signals (IDAT1-IDAT4) that are sequentially input to the signal controller 600 are processed with the doubling and TGM signal processing in the TGM unit 650 such that the HL-LH mode is sequentially applied. Also, the luminance change is generated between the first input image signal (IDAT1) and the second input image signal (IDAT2) among the four input image signals (IDAT1-IDAT4). The exemplary embodiment shown in FIG. 14 shows the falling condition (Falling) in which the gray of the second input image signal (IDAT2) is smaller than the gray of the first input image signal (IDAT1). Also, in the present exemplary embodiment, the break condition (Break) in which the luminance is changed in the way that the HL-LH mode is applied for the first input image signal (IDAT1) and the second input image signal (IDAT2) is applied.

FIG. 14 (*c*) shows the constant target gray for each frame of the target image that is processed with the doubling and TGM signal processing shown in FIG. 14 (*b*) and the luminance changes GP0, GP1, and GP2 of the image. When the HL-LH mode is only applied in the TGM unit 650 through the doubling and TGM signal processing of the image signal and the image is output without the processing in the DCC unit 640, like the curve GP0 before the correction of FIG. 14 (*c*), the liquid crystal cannot quickly form the luminance change of the second input image signal (IDAT2) such that the decreased luminance of the second input image signal (IDAT2) is not sufficiently expressed.

In contrast, as described above, when outputting the image as the correction image signal that is processed by the first correction in the DCC unit 640, the image as the correction image signal Gn' having a smaller gray than the original second input image signal (IDAT2) is output such that the decreased luminance of the second input image signal (IDAT2) may be sufficiently expressed like the first correction curve GP1 of FIG. 14 (*c*). In the first frame displaying the second image (L) among the frames that are processed by the doubling and TGM signal processing of the second input image signal (IDAT2), the slope of the first correction curve GP1 is different from the slope of the curve GP0 before the correction.

However, in this case, the first correction processing of the DCC unit 640 is also applied to the second frame displaying the first image (H) of the high luminance among the frames that are processed with the doubling and TGM signal processing of the second input image signal (IDAT2) such that the first image (H) having the sufficiently high luminance may not be displayed as shown in the first correction curve GP1. Accordingly, the difference between the luminance of the image and the target gray is largely increased in the second frame displaying the first image (H) among the frames that are processed with the doubling and TGM signal processing of the second input image signal (IDAT2). However, according to an exemplary embodiment of the present invention, the DCC unit 640 of the signal controller 600 multiplies the predetermined weight value (W(g)) by the correction image signal that is firstly corrected or applies the post-processing vicariously outputting the current image signal Gn before the first correction as the final correction image signal Gn* in the second frame among the frames that are processed with the doubling and TGM signal processing of the second input image signal (IDAT2) such that the image of the sufficiently high luminance close to the target gray may be displayed in the second frame among the frames that are processed with the doubling and TGM signal processing of the second input image signal (IDAT2) like the secondary correction curve GP2 of FIG. 14 (*c*).

In an exemplary embodiment, the weight value (W(g)) used for the post-processing has the value equal to or more than 0 and equal to or less then 1, as shown in FIG. 19.

Figure 15:
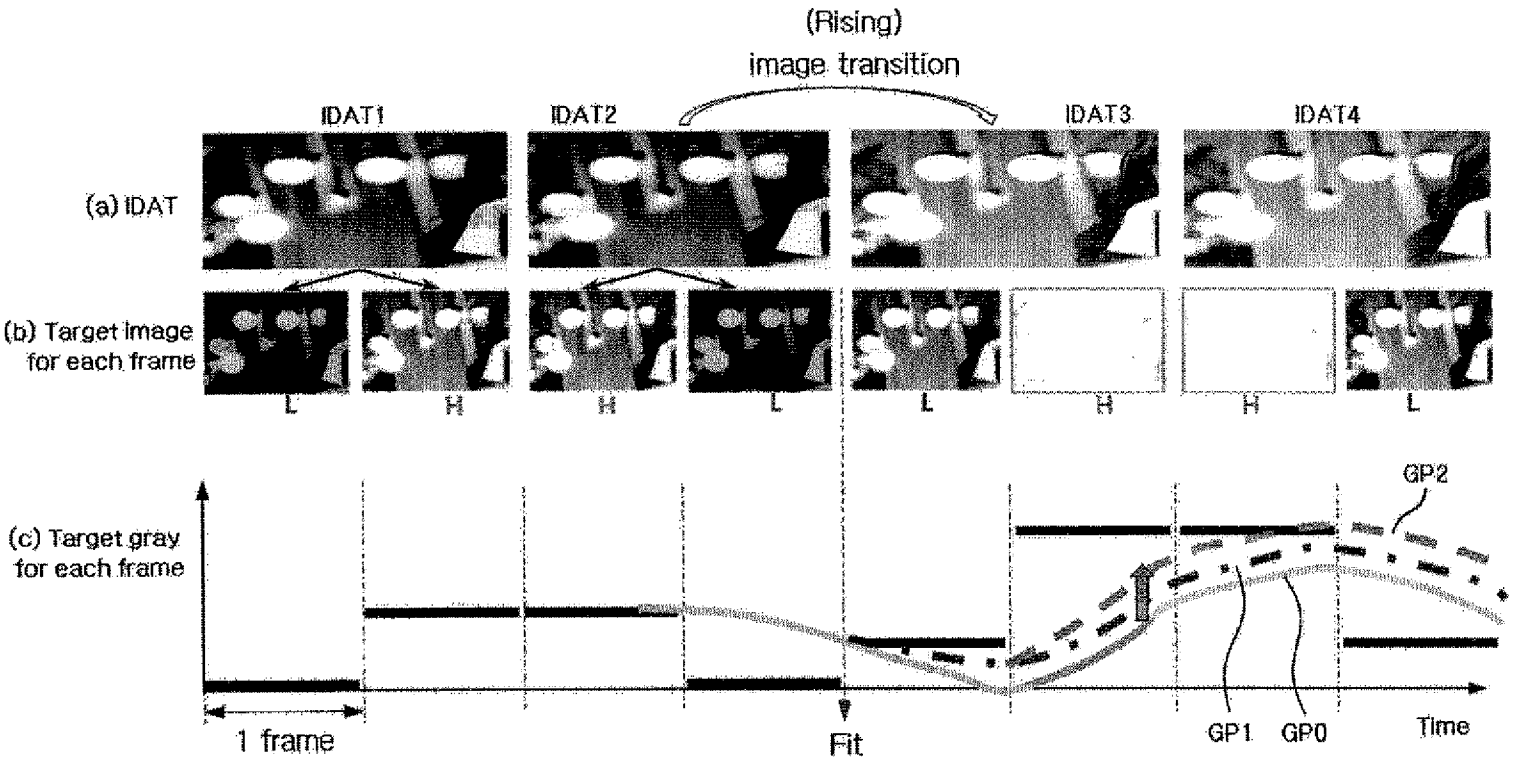

Next, referring to FIG. 15 (*a*) and FIG. 15 (*b*), the four continuously input image signals (IDAT1-IDAT4) that are sequentially input to the signal controller 600 are processed with the doubling and TGM signal processing in the TGM unit 650 such that the LH-HL mode is sequentially applied. Also, the luminance change is generated between the second input image signal (IDAT2) and the third input image signal (IDAT3) among the four input image signals (IDAT1-IDAT4). The exemplary embodiment shown in FIG. 15 shows the rising condition (Rising) in which the gray of the third input image signal (IDAT3) is larger than the gray of the second input image signal (IDAT2). Also, in the present exemplary embodiment, the HL-LH mode is applied once for the first input image signal (IDAT1) and the second input image signal (IDAT2) such that the fit condition (Fit) in which the luminance is changed after one TGM mode is finished is applied.

FIG. 15 (*c*) shows the constant target gray for each frame of the target image that is processed with the doubling and TGM signal processing shown in FIG. 15 (*b*) and the luminance changes GP0, GP1, and GP2 of the image. When the LH-HL mode is only applied in the TGM unit 650 through the doubling and TGM signal processing of the image signal and the image is output without the processing in the DCC unit 640, like the curve GP0 before the correction of FIG. 15 (*c*), the liquid crystal cannot quickly form the luminance change of the third input image signal (IDAT3) such that the increased luminance of the third input image signal (IDAT3) is not sufficiently expressed.

In contrast, as described above, when outputting the image as the correction image signal that is processed by the first correction in the DCC unit 640, the image as the correction image signal Gn' having a larger gray than the original third input image signal (IDAT3) is output such that the increased luminance of the third input image signal (IDAT3) may be sufficiently expressed like the first correction curve GP1 of FIG. 15 (*c*). In the first frame displaying the first image (H) among the frames that are processed by the doubling and TGM signal processing of the third input image signal (IDAT3), the slope of the first correction curve GP1 is different from the slope of the curve GP0 before the correction.

However, in this case, the first correction processing of the DCC unit 640 is also applied to the second frame displaying the first image (H) of the high luminance among the frames that are processed with the doubling and TGM signal processing of the third input image signal (IDAT3), but the first image (H) having the sufficiently high luminance may not be displayed as shown in the first correction curve GP1. Accordingly, the difference between the luminance of the image and the target gray is largely increased in the second frame displaying the first image (H) among the frames that are processed with the doubling and TGM signal processing of the third input image signal (IDAT3). However, according to an exemplary embodiment of the present invention, the DCC unit 640 of the signal controller 600 multiplies the predetermined weight value (W(g)) by the correction image signal that is firstly corrected or applies the post-processing vicariously outputting the current image signal Gn before the first correction as the final correction image signal Gn* in the second frame among the frames that are processed with the doubling and TGM signal processing of the third input image signal (IDAT3) such that the image of the sufficiently high luminance close to the target gray may be displayed in the second frame among the frames that are processed with the doubling and TGM signal processing of the third input image signal (IDAT3) like the secondary correction curve GP2 of FIG. 15 (*c*). This post-processing method may be the same as the rising condition (Rising) and the break condition (Break) of the HL-LH mode of the exemplary embodiment shown in FIG. 12. That is, the exemplary embodiment shown in FIG. 12 and the exemplary embodiment shown in FIG. 15 may perform the post-processing by using the same weight value (W(g)).

In an exemplary embodiment, the weight value (W(g)) used for the post-processing has a value equal to or more than 0 and equal to or less than 1, as shown in FIG. 19.

Figure 16:
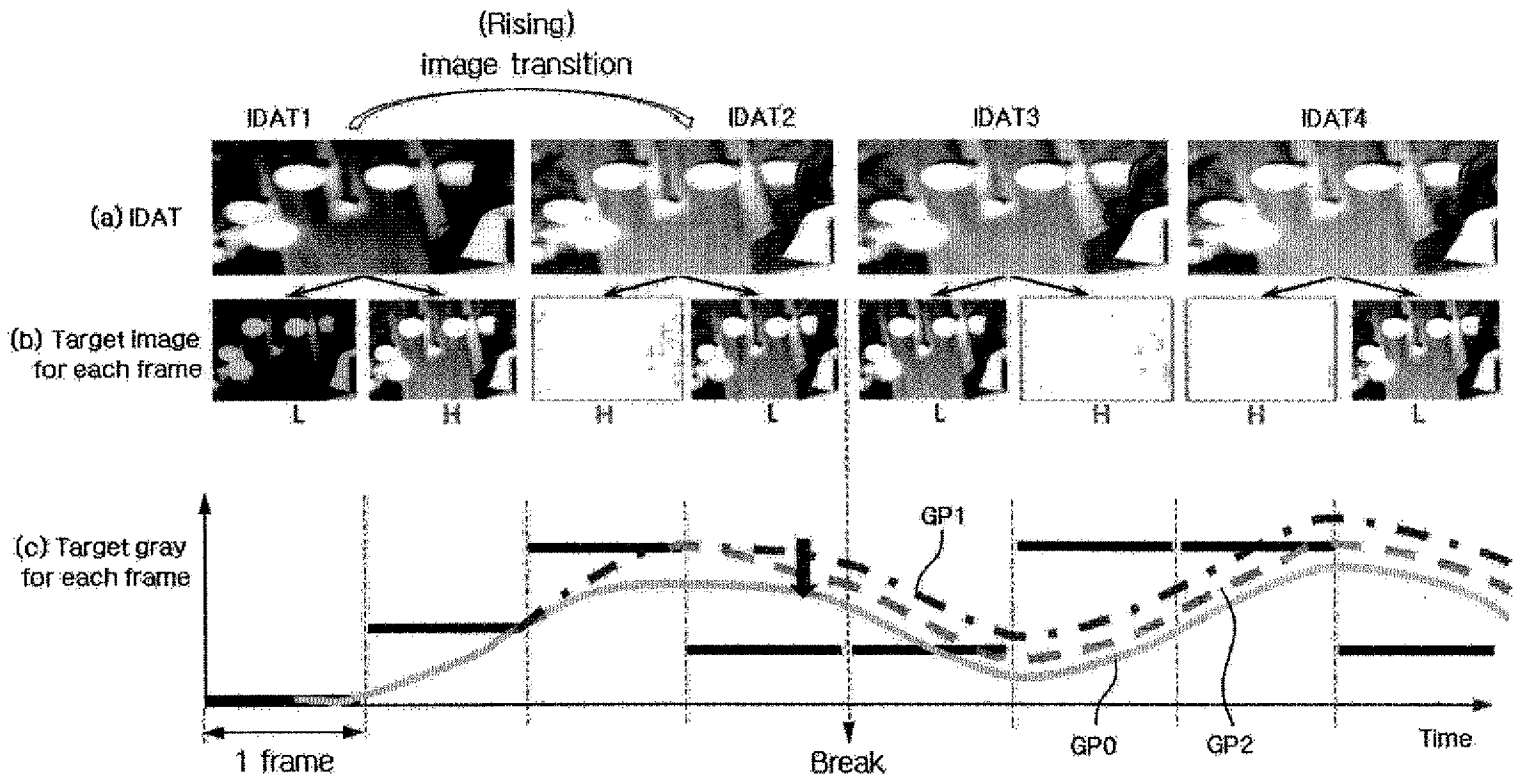

Next, referring to FIG. 16 (*a*) and FIG. 16 (*b*), the four continuously input image signals (IDAT1-IDAT4) that are sequentially input to the signal controller 600 are processed with the doubling and TGM signal processing in the TGM unit 650 such that the LH-HL mode is sequentially applied. Also, the luminance change is generated between the first input image signal (IDAT1) and the second input image signal (IDAT2) among the four input image signals (IDAT1-IDAT4). The exemplary embodiment shown in FIG. 16 shows the rising condition (Rising) in which the gray of the second input image signal (IDAT2) is larger than the gray of the first input image signal (IDAT1). Also, in the present exemplary embodiment, the break condition (Break) in which the luminance is changed in the way that the LH-HL mode is applied for the first input image signal (IDAT1) and the second input image signal (IDAT2) is applied.

FIG. 16 (*c*) shows the constant target gray for each frame of the target image that is processed with the doubling and TGM signal processing shown in FIG. 16 (*b*) and the luminance changes GP0, GP1, and GP2 of the image. When the LH-HL mode is only applied in the TGM unit 650 through the doubling and TGM signal processing of the image signal and the image is output without the processing in the DCC unit 640, like the curve GP0 before the correction of FIG. 16 (*c*), the liquid crystal cannot quickly form the luminance change of the third input image signal (IDAT3) such that the increased luminance of the third input image signal (IDAT3) is not sufficiently expressed. In contrast, as described above, when outputting the image as the correction image signal that is processed by the first correction in the DCC unit 640, the image as the correction image signal Gn' having the larger gray than the original third input image signal (IDAT3) is output such that the increased luminance of the second input image signal (IDAT2) may be sufficiently expressed like the first correction curve GP1 of FIG. 16 (*c*). In the first frame displaying the first image (H) among the frames that are processed by the doubling and TGM signal processing of the second input image signal (IDAT3), the slope of the first correction curve GP1 is different from the slope of the curve GP0 before the correction.

However, in this case, the first correction processing of the DCC unit 640 is also applied to the second frame displaying the second image (L) of the low luminance among the frames that are processed with the doubling and TGM signal processing of the second input image signal (IDAT2) such that the second image (L) having the sufficiently low luminance may not be displayed as shown in the first correction curve GP1. Accordingly, the difference between the luminance of the image and the target gray is largely increased in the second frame displaying the second image (L) among the frames that are processed with the doubling and TGM signal processing of the second input image signal (IDAT2). However, according to an exemplary embodiment of the present invention, the DCC unit 640 of the signal controller 600 multiplies the predetermined weight value (W(g)) by the correction image signal that is firstly corrected or applies the post-processing vicariously outputting the current image signal Gn before the first correction as the final correction image signal Gn* in the second frame among the frames that are processed with the doubling and TGM signal processing of the second input image signal (IDAT2) such that the image of the sufficiently low luminance close the target gray may be displayed in the second frame among the frame that are processed with the doubling and TGM signal processing of the second input image signal (IDAT2) like the secondary correction curve GP2 of FIG. 16 (*c*). This post-processing method may be the same as the rising condition (Rising) and the fit condition (Fit) of the HL-LH mode of the exemplary embodiment shown in FIG. 11. That is, the exemplary embodiment shown in FIG. 11 and the exemplary embodiment shown in FIG. 16 may perform the post-processing by using the same weight value (W(g)).

In an exemplary embodiment, the weight value (W(g)) used for the post-processing has a value equal to or more than 1, as shown in FIG. 19.

Figure 17:
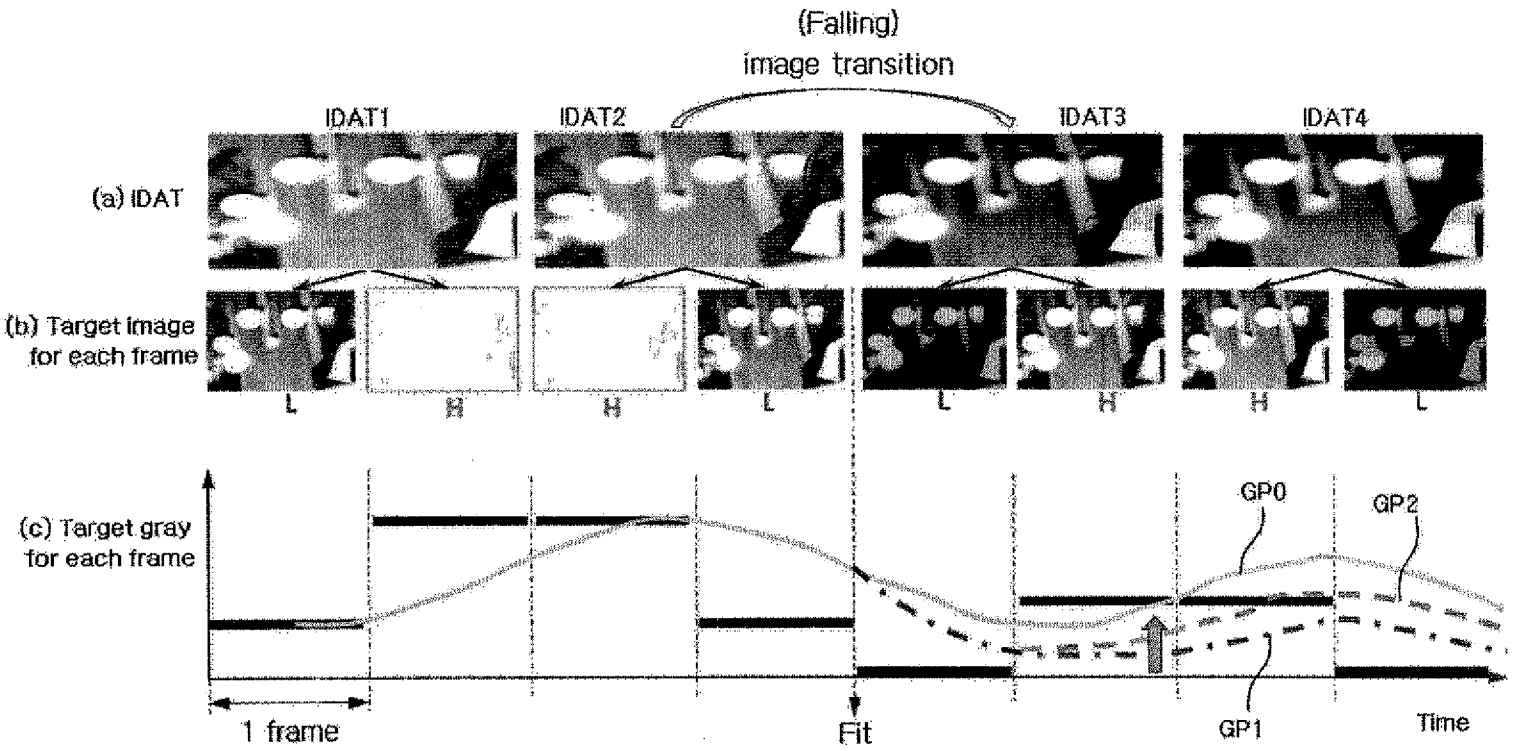

Next, referring to FIG. 17 (*a*) and FIG. 17 (*b*), the four continuously input image signals (IDAT1-IDAT4) that are sequentially input to the signal controller 600 are processed with the doubling and TGM signal processing in the TGM unit 650 such that the LH-HL mode is sequentially applied. Also, the luminance change is generated between the second input image signal (IDAT2) and the third input image signal (IDAT3) among the four input image signals (IDAT1-IDAT4). The exemplary embodiment shown in FIG. 17 shows the falling condition (Falling) in which the gray of the third input image signal (IDAT3) is larger than the gray of the second input image signal (IDAT2). Also, in the present exemplary embodiment, the LH-HL mode is applied once for the first input image signal (IDAT1) and the second input image signal (IDAT2) such that the fit condition (Fit) in which the luminance is changed after one TGM mode is finished is applied.

FIG. 17 (*c*) shows the constant target gray for each frame of the target image that is processed with the doubling and TGM signal processing shown in FIG. 17 (*b*) and the luminance changes GP0, GP1, and GP2 of the image. When the LH-HL mode is only applied in the TGM unit 650 through the doubling and TGM signal processing of the image signal and the image is output without the processing in the DCC unit 640, like the curve GP0 before the correction of FIG. 17 (*c*), the liquid crystal cannot quickly form the luminance change of the third input image signal (IDAT3) such that the decreased luminance of the third input image signal (IDAT3) is not sufficiently expressed.

In contrast, as described above, when outputting the image as the correction image signal that is processed by the first correction in the DCC unit 640, the image as the correction image signal. Gn' having a smaller gray than the original third input image signal (IDAT3) is output such that the decreased luminance of the third input image signal (IDAT3) may be sufficiently expressed like the first correction curve GP1 of FIG. 17 (*c*). In the first frame displaying the second image (L) among the frames that are processed by the doubling and TGM signal processing of the third input image signal (IDAT3), the slope of the first correction curve GP1 is different from the slope of the curve GP0 before the correction.

However, in this case, the first correction processing of the DCC unit 640 is also applied to the second frame displaying the first image (H) of the high luminance among the frames that are processed with the doubling and TGM signal processing of the third input image signal (IDAT3) such that the first image (H) having the sufficiently high luminance may not be displayed as shown in the first correction curve GP1. Accordingly, the difference between the luminance of the image and the target gray is largely increased in the second frame displaying the first image (H) among the frames that are processed with the doubling and TGM signal processing of the third input image signal (IDAT3). However, according to an exemplary embodiment of the present invention, the DCC unit 640 of the signal controller 600 multiplies the predetermined weight value (W(g)) by the correction image signal that is firstly corrected or applies the post-processing vicariously outputting the current image signal Gn before the first correction as the final correction image signal Gn* in the second frame among the frames that are processed with the doubling and TGM signal processing of the third input image signal (IDAT3) such that the image of the sufficiently high luminance close to the target gray may be displayed in the second frame among the frames that are processed with the doubling and TGM signal processing of the third input image signal (IDAT3) like the secondary correction curve GP2 of FIG. 17 (*c*). This post-processing method may be the same as the falling condition (Falling) and the break condition (Break) of the HL-LH mode of the exemplary embodiment shown in FIG. 14. That is, the exemplary embodiment shown in FIG. 14 and the exemplary embodiment shown in FIG. 17 may perform the post-processing by using the same weight value (W(g)).

In an exemplary embodiment, the weight value (W(g)) used for the post-processing has a value equal to or more than 1, as shown in FIG. 19.

Figure 18:
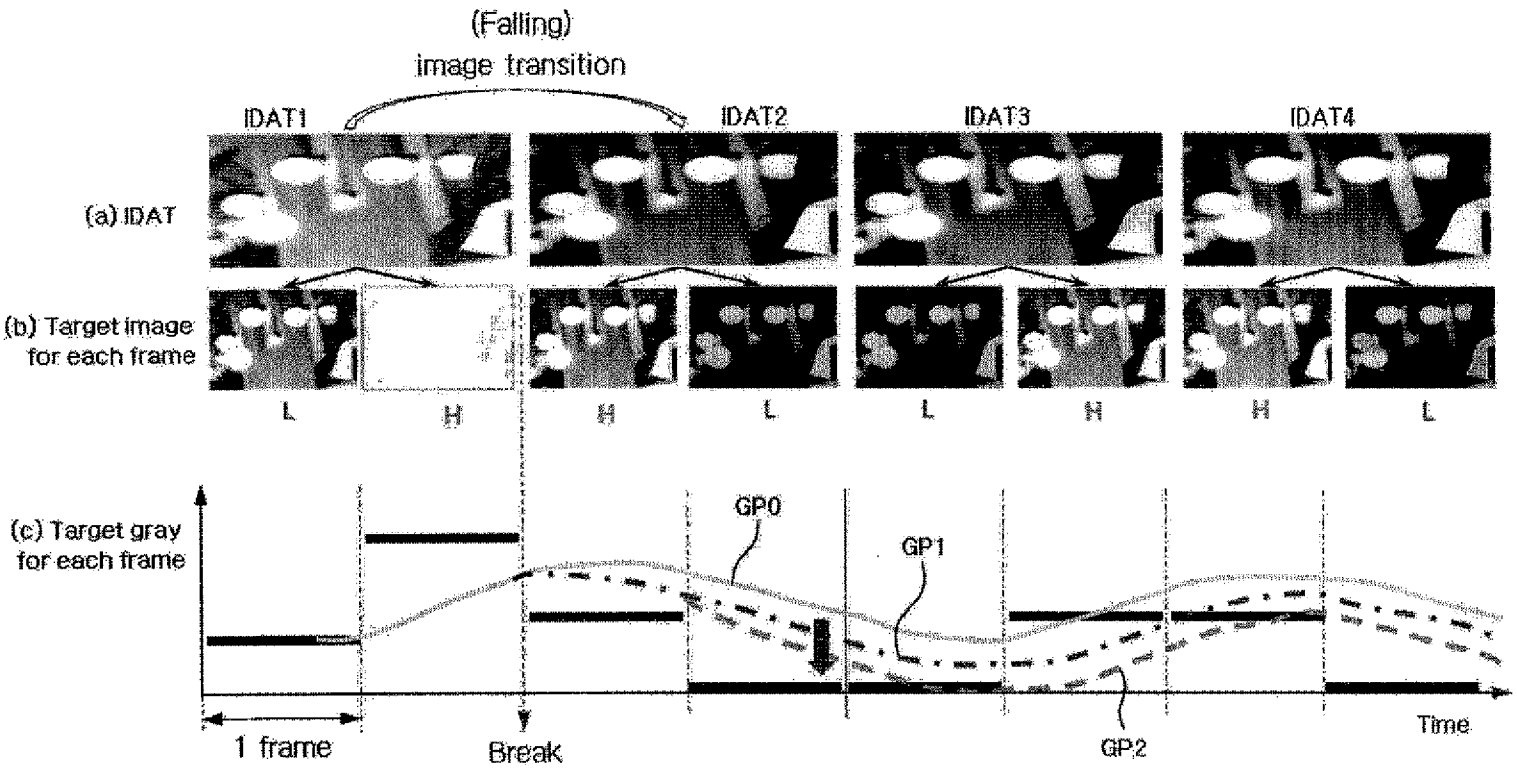

Next, referring to FIG. 18 (*a*) and FIG. 18 (*b*), the four continuously input image signals (IDAT1-IDAT4) that are sequentially input to the signal controller 600 are processed with the doubling and TOM signal processing in the TGM unit 650 such that the LH-HL mode is sequentially applied. Also, the luminance change is generated between the first input image signal (IDAT1) and the second input image signal (IDAT2) among the four input image signals (IDAT1-IDAT4). The exemplary embodiment shown in FIG. 18 shows the falling condition (Falling) in which the gray of the second input image signal (IDAT2) is larger than the gray of the first input image signal (IDAT1). Also, in the present exemplary embodiment, the break condition (Break) in which the luminance is changed in the way that the LH-HL mode is applied for the first input image signal (IDAT1) and the second input image signal (IDAT2) is applied one time.

FIG. 18 (*c*) shows the constant target gray for each frame of the target image that is processed with the doubling and TGM signal processing shown in FIG. 18 (*b*) and the luminance changes GP0, GP1, and GP2 of the image. When the LH-HL mode is only applied in the TGM unit 650 through the doubling and TGM signal processing of the image signal and the image is output without the processing in the DCC unit 640, like the curve GP0 before the correction of FIG. 16 (*c*), the liquid crystal cannot quickly form the luminance change of the second input image signal (IDAT2) such that the decreased luminance of the second input image signal (IDAT2) is not sufficiently expressed.

In contrast, as described above, when outputting the image as the correction image signal that is processed by the first correction in the DCC unit 640, the image as the correction image signal Gn' having the smaller gray than the original third input image signal (IDAT3) is output such that the decreased luminance of the second input image signal (IDAT2) may be sufficiently expressed like the first correction curve GP1 of FIG. 18 (*c*). In the first frame displaying the first image (H) among the frames that are processed by the doubling and TGM signal processing of the second input image signal (IDAT2), the slope of the first correction curve GP1 is different from the slope of the curve GP0 before the correction.

However, in this case, the first correction processing of the DCC unit 640 is also applied to the second frame displaying the second image (L) of the low luminance among the frames that are processed with the doubling and TGM signal processing of the second input image signal (IDAT2) such that the second image (L) having the sufficiently low luminance may not be displayed as shown in the first correction curve GP1. Accordingly, the difference between the luminance of the image and the target gray is largely increased in the second frame displaying the second image (L) among the frames that are processed with the doubling and TGM signal processing of the second input image signal (IDAT2). However, according to an exemplary embodiment of the present invention, the DCC unit 640 of the signal controller 600 multiplies the predetermined weight value (W(g)) by the correction image signal that is firstly corrected or applies the post-processing vicariously outputting the current image signal Gn before the first correction as the final correction image signal Gn* in the second frame among the frames that are processed with the doubling and TGM signal processing of the second input image signal (IDAT2) such that the image of the sufficiently low luminance close the target gray may be displayed in the second frame among the frames that are processed with the doubling and TGM signal processing of the second input image signal (IDAT2) like the secondary correction curve GP2 of FIG. 18 (*c*). This post-processing method may be the same as the falling condition (Falling) and the fit condition (Fit) of the HL-LH mode of the exemplary embodiment shown in FIG. 13. That is, the exemplary embodiment shown in FIG. 13 and the exemplary embodiment shown in FIG. 18 may perform the post-processing by using the same weight value (W(g)).

In an exemplary embodiment, the weight value (W(g)) used for the post-processing has a value equal to or more than 0 and equal to or less than 1, as shown in FIG. 19.

FIG. 20 summarizes the use of the same lookup table (LUT) of the weight value (W(g)) capable of being applied to the post-processing among the several conditions of the HL-LH mode and LH-HL mode of the TGM shown in 11 to FIG. 18, and the luminance change.

The case of the rising condition (Rising) and the fit condition (Fit) among the HL-LH mode may use the lookup table (LUT) of the same weight value (W(g)) as the case of the rising condition (Rising) and the break condition (Break) among the LH-HL mode to perform the post-processing, The case of the rising condition (Rising) and the break condition (Break) of the HL-LH mode may use the lookup table (LUT) of the same weight value (W(g)) as the case of the rising condition (Rising) and the fit condition (Fit) of the LH-HL mode to perform the post-processing. The case of the falling condition (Falling) and the fit condition (Fit) of the HL-LH mode may use the case of the lookup table (LUT) of the same weight value (W(g)) as the case of the falling condition (Falling) and break condition (Break) of the LH-HL mode to perform the post-processing. The case of the falling condition (Falling) and the break condition (Break) of the HL-LH mode may use the lookup table (LUT) of the same weight value (W(g)) as the case of the falling condition (Falling) and the fit condition (Fit) of the LH-HL mode to perform the post-processing.

In the post-processing using the weight value (W(g)), the weight value (W(g)) to be applied may be selected according to the corresponding TGM mode and the luminance change condition by using the flag signal generated in the comparator 630.

According to an exemplary embodiment of the present invention, the liquid crystal display is operated with the TGM mode of the HL-HL mode or the LH-LH mode. In this case, the display sequence of the first image (II) and the second image (L) are equally repeated per two frames for each of the first input image signal (IDAT1) and the second input image signal (IDAT2) such that it may be substantially referred to as the HL mode or the LH mode. That is, the same modes are repeated for two frames such that the fit condition (Fit) is always applied when the change is generated to the gray of the first input image signal (IDAT1) and the second input image signal (IDAT2). Accordingly, in the case that the liquid crystal display according to an exemplary embodiment of the present invention is operated with the TGM mode of the HL-HL mode or the LH-LH mode, the fit condition (Fit) that was previously described may be applied.

Next, a signal controller of the liquid crystal display and an image signal processing method according to an exemplary embodiment of the present invention will be described with reference to FIG. 21 along with the described drawings.

Figure 21:
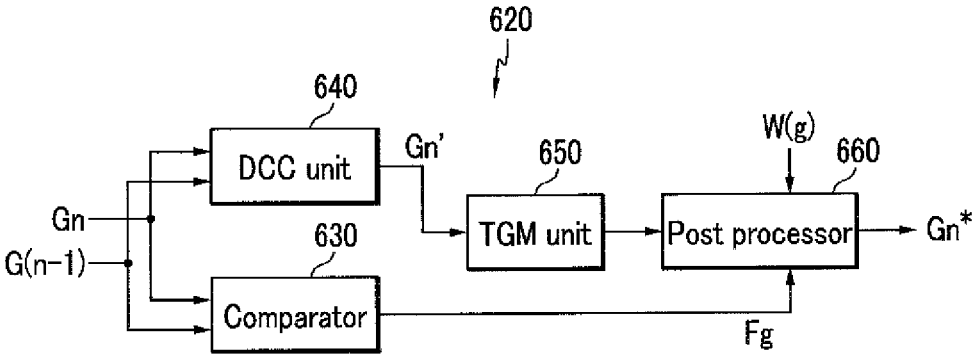
FIG. 21 is a block diagram of an image signal processor of a liquid crystal display according to an exemplary embodiment of the present invention.

FIG. 21 is a block diagram of an image signal processor of a liquid crystal display according to an exemplary embodiment of the present invention, FIG. 22 is a view of one example of a flag signal applied to an HL-LH mode of a TGM type in an image signal processing process in a liquid crystal display according to an exemplary embodiment of the present invention, and FIG. 23 is a view of one example of a flag signal applied to an LH-HL mode of a TGM type in an image signal processing process in a liquid crystal display according to an exemplary embodiment of the present invention.

Referring to FIG. 21, the image signal processor 620 of the signal controller 600 of the liquid crystal display according to an exemplary embodiment of the present invention includes a comparator 630, a DCC unit 640, a TGM unit 650, and a post processor 660.

The comparator 630 compares the previous image signal G(n−1) and the current image signal Gn to generate a flag signal (Fg). The flag signal (Fg) may be stored to a separate memory and then may be transmitted to the post processor 660. In an exemplary embodiment, the flag signal (Fg) has four values according to the luminance change condition of the four combinations for each TGM mode as shown in FIG. 22 and FIG. 23.

FIG. 22 is a two bit exemplary embodiment of the flag signal (Fg) to be applied to the four luminance change conditions in a case of the HL-LH mode among the TGM modes, and FIG. 23 is a two bit exemplary embodiment of the flag signal (Fg) to be applied to the four luminance change conditions in a case of the LH-HL mode among the TGM modes.

For example, as the flag signal (Fg), the case of the rising condition (Rising) and the fit condition (Fit) among the HL-LH mode may be represented by '11' along with the case of the rising condition (Rising) and the break condition (Break) for the LH-HL mode, the case of the rising condition (Rising) and the break condition (Break) for the HL-LH mode may be represented by '01' along with the rising condition (Rising) and the fit condition (Fit) for the LH-HL mode, the case of the falling condition (Falling) and the fit condition (Fit) for the HL-LH mode may be represented by '10' along with the case of the falling condition (Falling) and break condition (Break) for the LH-HL mode, and the case of the falling condition (Falling) and the break condition (Break) for the HL-LH mode may be represented by '00' along with the case of the falling condition (Falling) and the fit condition (Fit) for the LH-HL mode.

As described above, the DCC unit 640 compares the previous image signal G(n−1) and the current image signal Gn according to the DCC method according to several techniques, and firstly corrects the current image signal Gn according to the predetermined condition when the grays of two image signals G(n−1) and Gn are different to generate the correction image signal Gn'.

The TGM unit 650 receives the correction image signal Gn' from the DCC unit 640 and processes it into a plurality of frames through the doubling and TGM signal processing.

The post processor 660 receives the correction image signal Gn' that is processed with the doubling and TGM signal from the TGM unit 650 for the post-processing. That is, the post processor 660 may output the image signal before the first correction as the final correction image signal Gn' in one frame of two frames that are processed with the doubling and TGM signal, may multiply the weight value (W(g)) stored in the separate memory by the correction image signal Gn', or may vicariously output the current image signal Gn before the first correction as the final correction image signal Gn*. In this post-processing, the post processor 660 may select the weight value (W(g)) by using the flag signal (Fg) generated in the comparator 630.

For example, the case of the rising condition (Rising) and the fit condition (Fit) for the HL-LH mode and the case of the rising condition (Rising) and the break condition (Break) for the LH-HL mode are represented by '11' of the same flag signal (Fg) and may be post-processed by using the same weight value (W(g)), the case of the rising condition (Rising) and the break condition (Break) for the HL-LH mode and the case of the rising condition (Rising) and the fit condition (Fit) for the LH-HL mode are represented by '01' of the same flag signal (Fg) and may be post-processed by using the same weight value (W(g)), the case of the falling condition (Falling) and fit condition (Fit) among the HL-LH mode and the case of the falling condition (Falling) and the break condition (Break) for the LH-HL mode are represented by '10' of the same flag signal (Fg) and may be post-processed by using the same weight value (W(g)), and the case of the falling condition (Falling) and the break condition (Break) for the HL-LH mode and the case of the falling condition (Falling) and the fit condition (Fit) for the LH-HL mode are represented by '00' of the same flag signal (Fg) and may be post-processed by using the same weight value (W(g)).

Next, a signal controller of the liquid crystal display and an image signal processing method according to an exemplary embodiment of the present invention will be described with reference to FIG. 24, FIG. 25, and FIG. 26. The same constituent elements as in the previous exemplary embodiment are indicated by the same reference numerals, and thus the same description is omitted.

Figure 24:
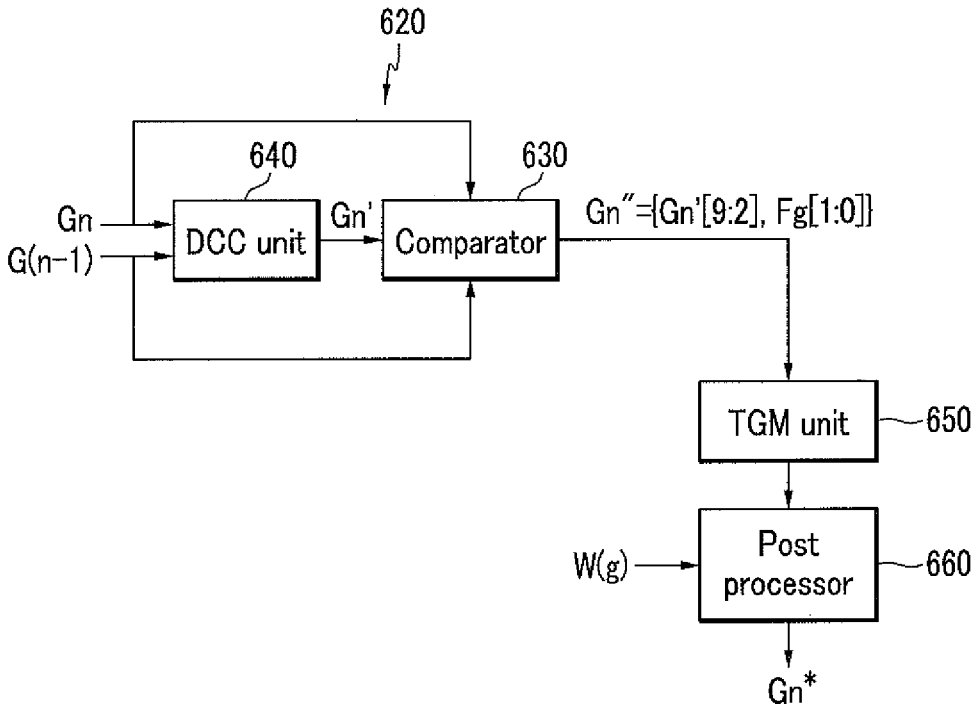
FIG. 24 to FIG. 26 are block diagrams of an image signal processor of a liquid crystal display according to an exemplary embodiment of the present invention.

FIG. 24 is a block diagram of an image signal processor of a liquid crystal display according to an exemplary embodiment of the present invention.

In the present exemplary embodiment, the DCC unit 640 compares the previous image signal G(n−1) and the current image signal Gn, and firstly corrects the current image signal Gn when the grays of two image signals G(n−1) and Gn are different from one another to generate the correction image signal Gn'.

The comparator 630 compares the previous image signal G(n−1) and the current image signal Gn to generate the flag signal (Fg), and then adds the flag signal (Fg) to the lower bit of the correction image signal Gn' input from the DCC unit 640 to generate the modified correction image signal Gn". For example, when the image signal before the first correction is 10 bits, the correction image signal Gn' that is added to the flag signal (Fg) may include the flag signal (Fg) of 2 bits (e.g., Fg[1:0]) and the correction image signal Gn' of 8 bits (e.g., Gn'[9:2]).

The TGM unit 650 receives the modified correction image signal Gn" resulting from adding the flag signal (Fg) to the correction image signal Gn' from the comparator 630, and processes it into a plurality of frames through the doubling and TGM signal processing.

The post processor 660 receives the output of the TGM unit 650 that is a result of the TGM unit 650 performing a doubling and TGM signal processing on the modified correction image signal Gn" for post-processing. The post processor 660 may output the image signal before the first correction as the final correction image signal Gn* in one frame of two frames that is processed with the doubling and TGM signal processing. In an exemplary embodiment, the post processor 660 receives the lower bit(s) of the image signal before the first correction from the DCC unit 640 to generate the final correction image signal Gn* of the same bit as the image signal before the first correction. For example, the post processor 660 may receive two lower bits of the image Gn and two lower bits of image Gn' to produce 10 bits of a final correction image Gn*.

Alternatively, the post processor 660 may multiply the weight value (W(g)) by the correction image signal that is firstly corrected in one frame of two frames that are processed with the doubling and TGM signal processing, or may vicariously output the current image signal Gn before the first correction as the final correction image signal Gn*. The weight value (W(g)) may be selected by using the flag signal (Fg) generated in the comparator 630.

The frame that is processed in the post processor 660 may be the latter frame among two frames that are processed with the doubling and TGM signal processing for the input image signal (IDAT) in which the luminance is changed.

Figure 25:
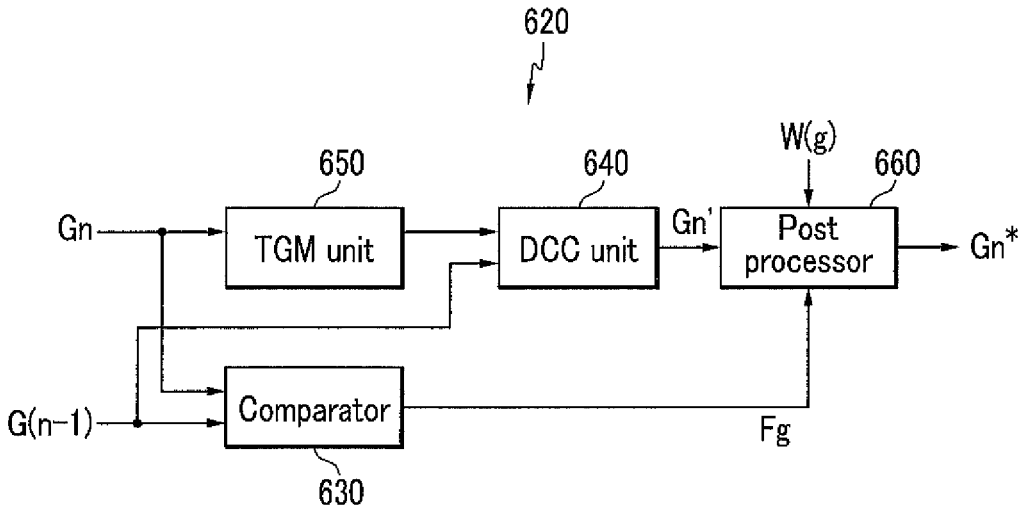

FIG. 25 is a block diagram of an image signal processor of a liquid crystal display according to an exemplary embodiment of the present invention.

In the present exemplary embodiment, the comparator 630 compares the previous image signal G(n−1) and the current image signal Gn to generate the flag signal (Fg). The flag signal (Fg) may be stored to a separate memory and then may be transmitted to the post processor 660.

The TGM unit 650 receives the current image signal Gn and processes it into a plurality of frames through the doubling and TGM signal processing.

The DCC unit 640 receives the previous image signal G(n−1) and a signal resulting from the TGM unit 650 performing the doubling and TGM processing on the current image signal Gn, and performs the DCC to generate the correction image signal Gn'.

The post processor 660 receives the correction image signal Gn' that is processed with the doubling and TGM signal processing from the DCC unit 640 for the post-processing. For example, the post processor 660 may output the image signal before the first correction as the final correction image signal Gn* in one frame of two frames that are processed with the doubling and TGM signal processing, may multiply the weight value (W(g)) by the correction image signal Gn', or may vicariously output the current image signal Gn before the first correction as the final correction image signal Gn*. In this post-processing, the post processor 660 may select the weight value (W(g)) by using the flag signal (Fg) generated in the comparator 630.

Figure 26:
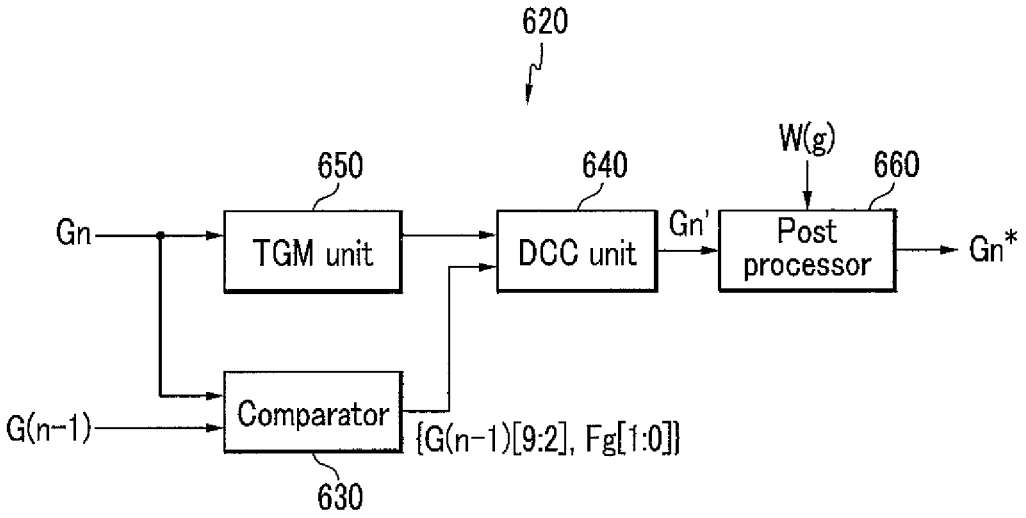

FIG. 26 is a block diagram of an image signal processor of a liquid crystal display according to an exemplary embodiment of the present invention.

In the present exemplary embodiment, the comparator 630 does not separately output the flag signal (Fg) to the post processor 660 and adds the flag signal (Fg) to the lower bit of the previous image signal G(n−1) to output the previous image signal including the flag signal (Fg) to the DCC unit 640. For example, when the image signal before the first correction is 10 bits, the previous image signal that is added with the flag signal (Fg) may include the flag signal (Fg) of 2 bits (e.g., Fg[1:0]) and the previous image signal G(n−1) of 8 bits (e.g., G(n−1)[9:2].

The DCC unit 640 receives the current image signal Gn that is processed with the doubling and TGM signal processing from the TGM unit 650, and the previous image signal that is added with the flag signal (Fg) from the comparator 630 and performs the DCC to generate the correction image signal Gn'.

The post processor 660 receives the correction image signal Gn' that is processed with the doubling and TGM signal processing from the DCC unit 640 for the post-processing. For example, the post processor 660 may output the image signal before the first correction as the final correction image signal Gn* in one frame of two frames that are processed with the doubling and TGM signal processing, may multiply the weight value (W(g)) by the correction image signal Gn', or may vicariously output the image signal Gn before the first correction as the final correction image signal Gn*. In this post-processing, the post processor 660 may select the weight value (W(g)) by using the flag signal (Fg) of the previous image signal added with the flag signal (Fg) input in the DCC unit 640. For example, although not shown in FIG. 24, the post processor 660 may receive the same signal Gn that is input to the DCC unit 640 when it needs to output the signal Gn without correction as Gn*.

An image signal processing method of the signal controller 600 according to an exemplary embodiment of the present invention will be described with reference to FIG. 27 and FIG. 28.

Figure 27:
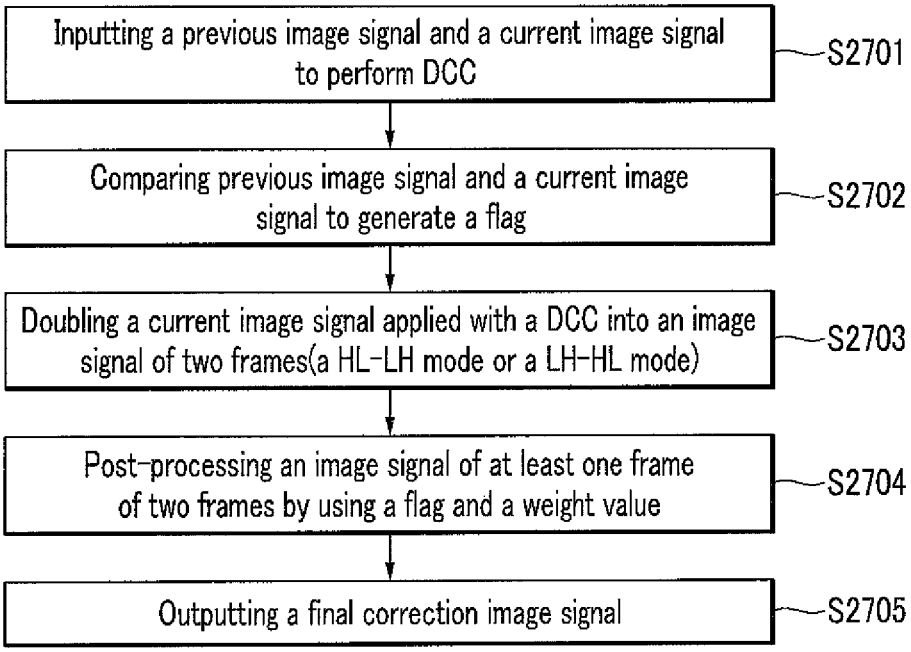
FIG. 27 and FIG. 28 are flowcharts showing an image signal processing method according to a liquid crystal display according to an exemplary embodiment of the present invention.
Figure 28:
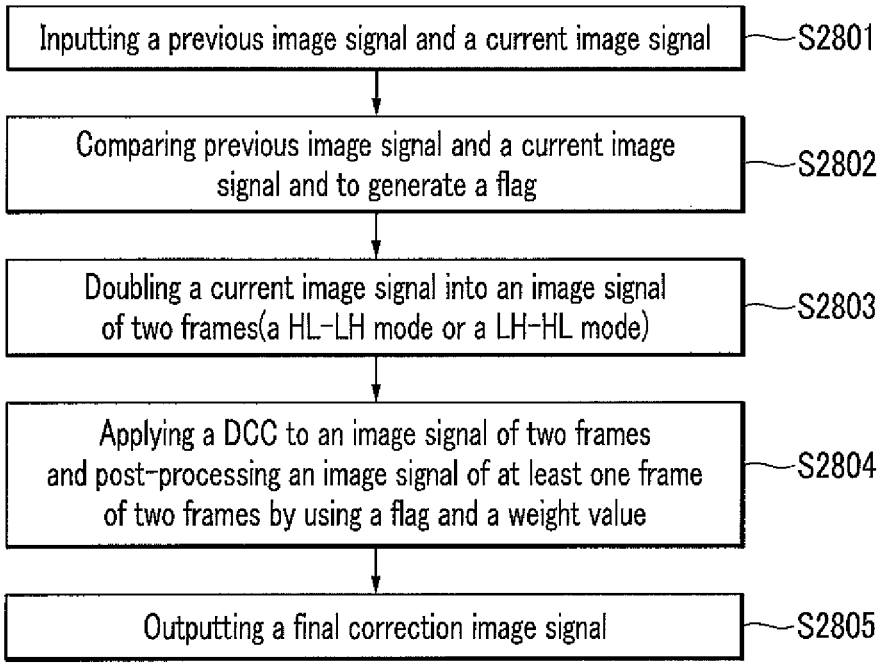

FIG. 27 and FIG. 28 are flowcharts showing the image signal processing method of the liquid crystal display according to an exemplary embodiment of the present invention.

Referring to FIG. 27, the image signal processing method of the present exemplary embodiment is similar to the exemplary embodiment shown in FIG. 21 to FIG. 24. The previous image signal G(n−1) and the current image signal Gn are input from an external source to perform DCC to generate a correction image signal Gn' (S2701). The two signals are compared to generate the flag signal (Fg) (S2702). Next, the current image signal that is applied with the DCC and is corrected, that is, the correction image signal Gn' is processed into two frames through the doubling and TGM signal processing (S2703). In an exemplary embodiment, the doubling and TGM signal processing are performed according to the HL-LH mode or the LH-HL mode among the TGM modes. Next, the image signal of at least one frame of two frames that are processed through the doubling and TGM signal processing, for example, the second frame, is post-processed by using the flag signal (Fg) and the weight value (W(g)) or the current image signal Gn before the first correction to output the final correction image signal Gn* (S2705).

Next, referring to FIG. 28, the image signal processing method of the present exemplary embodiment is similar to the exemplary embodiment shown in FIG. 25 and FIG. 26. The previous image signal G(n−1) and the current image signal Gn are input from a external source (S2801). The two signals are compared with each other to generate a flag signal (Fg) (S2802). The current image signal Gn is processed into two frames through the doubling and TGM signal processing (S2803). In an exemplary embodiment, the doubling and TGM signal processing are performed according to the HL-LH mode or the LH-HL mode among the TGM modes. Next, the DCC is applied to the image signal of two frames that are processed by the doubling and TGM signal processing, and the image signal of at least one frame of two frames that are processed through the doubling and TGM signal processing, for example, the second frame, is post-processed by using the flag signal (Fg) and the weight value (W(g)) or the current image signal Gn before the first correction to output the final correction image signal (S2804). A result of the post-processing is output as a final correction image signal Gn* (S2805).

As described above, according to at least one exemplary embodiment of the present invention, transmittance and lateral visibility may be improved by applying the TGM, and the liquid crystal response speed may be compensated thereby preventing the display quality degradation by applying the DCC. Also, through the post-processing of the DCC application, the luminance of the second frame among a plurality of frames that are processed by the doubling and TGM signal processing may be compensated to be close to the target luminance such that the lateral visibility improvement and the liquid crystal response speed compensation may be maximized.

While the invention has been described in connection with exemplary embodiments thereof, it is to be understood that the invention is not limited to the disclosed exemplary embodiments, but, on the contrary, is intended to cover various modifications and equivalent arrangements included within the spirit and scope of the disclosure.

What is claimed is:

1. A method of processing an image signal of a liquid crystal display, comprising:

receiving a previous image signal and a current image signal as two sequential input image signals;

performing a first correction dynamic capacitance compensation (DCC) and a doubling for the current image signal to generate a correction image signal comprising a plurality of doubled frames for the current image signal; and post-processing the correction image signal corresponding to a portion of the plurality of doubled frames to generate a final correction image signal, wherein the generating of the final correction image signal comprises outputting the current image signal before the first correction as the final correction image signal, or multiplying the correction image signal corresponding to the portion of the plurality of doubled frames by a weight value and outputting the multiplied result as the final correction image signal, wherein the generating of the correction image signal comprises doubling the current image signal or the correction image signal into the plurality of doubled frames according to a temporal gamma mixing (TGM) mode, wherein the TGM mode applied to the plurality of doubled frames for two sequential input images includes one of an HL-LH mode and an LH-HL mode.

2. The method of claim 1, wherein the generating of the correction image signal of the plurality of doubled frames comprises:

first correcting the current image signal or the doubled current image signal of the plurality of doubled frames.

3. The method of claim 1, wherein a gamma curve applied to the plurality of doubled frames includes a first gamma curve and a second gamma curve, a luminance of a first image (H) of one of the doubled frames according to the first gamma curve is not lower than a luminance of a second image (L) of another of the doubled frames according to the second gamma curve.

4. The method of claim 3, wherein the performing comprises:

setting a luminance of the input image signal to one of a break condition (Break) in which the luminance of the input image signal is changed in a middle of the TGM mode or a fit condition (Fit) in which the luminance of the input image signal is changed between two adjacent TGM modes; and setting a luminance of the current image signal to one of a rising condition (Rising) in which the luminance of the current image signal is higher than the luminance of the previous image signal or a falling condition (Falling) in which the luminance of the current image signal is lower than the luminance of the previous image signal.

5. The method of claim 4, further comprising comparing the previous image signal and the current image signal to generate a flag signal for the set condition, and the post-processing the correction image signal corresponding to the portion of the plurality of doubled frames to generate the final correction image signal comprises using the flag signal.

6. The method of claim 5, wherein the flag signal has four values according to the condition for each of the HL-LH mode and the LH-HL mode, and a value of the flag signal for the HL-LH mode forms a pair along with a value of the flag signal for the LH-HL mode and has a same value.

7. The method of claim 6, wherein the weight value is selected using the value of the flag signal.

8. The method of claim 7, wherein the weight value of the rising condition and the fit condition in the HL-LH mode and the weight value of the rising condition and the break condition in the LH-HL mode are equal to or more than 0 and equal to or less than 1, the weight value of the rising condition and the break condition in the HL-LH mode and the weight value of the rising condition and the fit condition in the LH-HL mode are equal to or more than 1, the weight value of the falling condition and the fit condition in the HL-LH mode and the weight value of the falling condition and the break condition in the LH-HL mode are equal to or more than 0 and equal to or less than 1, and the weight value of the falling condition and the break condition in the HL-LH mode and the weight value of the falling condition and the fit condition in the LH-HL mode are equal to or more than 1.

9. The method of claim 5, wherein the generating of the correction image signal of the plurality of doubled frames and the generating of the final correction image signal comprises:

generating the correction image signal by the first correcting of the current image signal;

doubling the correction image signal into the plurality of doubled frames; and post-processing the correction image signal corresponding to the portion of the plurality of doubled frames using the flag signal.

10. The method of claim 5, wherein the generating of the correction image signal of the plurality of doubled frames and the generating of the final correction image signal comprises:

generating the correction image signal by the first correcting of the current image signal;

adding the flag signal to a lower bit of the correction image signal;

doubling the correction image signal added by the flag signal into the plurality of doubled frames; and post-processing the correction image signal corresponding to the portion of the plurality of doubled frames using the flag signal added to the lower bit of the correction image signal.

11. The method of claim 5, wherein the generating of the correction image signal of the plurality of doubled frames and the generating of the final correction image signal comprises:

doubling the current image signal into the plurality of doubled frames;

generating the correction image signal by the first correcting of the doubled current image signal; and post-processing the correction image signal corresponding to the portion of the plurality of doubled frames using the flag signal.

12. The method of claim 5, wherein the generating of the correction image signal of the plurality of doubled frames and the generating of the final correction image signal comprises:

doubling the current image signal into the plurality of doubled frames;

adding the flag signal to a lower bit of the previous image signal;

generating the correction image signal by the first correcting of the doubled current image signal; and post-processing the portion of the plurality of doubled frames using the flag signal added to the lower bit of the previous image signal.

13. A liquid crystal display comprising:

an image signal processor configured to receive a previous image signal and a current image signal as two sequential input image signals, and perform a first correction dynamic capacitance compensation (DCC) and a doubling for the current image signal to generate a correction image signal comprising a plurality of doubled frames that are doubled for the current image signal, wherein the image signal processor comprises a post processor configured to post-process the correction image signal corresponding to a portion of the plurality of doubled frames to generate a final correction image signal, wherein the generating of the final correction image signal comprises outputting the current image signal before the first correction as the final correction image signal, or multiplying the correction image signal corresponding to the portion of the plurality of doubled frames by a weight value and outputting the multiplied result as the final correction image signal, wherein the image signal processor comprises a temporal gamma mixing TGM unit configured to double the current image signal or the correction image signal into the plurality of doubled frames according to a TGM mode, and wherein the TGM mode applied to the plurality of doubled frames for two sequential input images includes one of an HL-LH mode and an LH-HL mode.

14. The liquid crystal display of claim 13, wherein the image signal processor comprises:

a DCC unit first correcting the current image signal or the doubled current image signal of the plurality of doubled frames.

15. The liquid crystal display of claim 13, wherein:

a gamma curve applied to the plurality of doubled frames includes a first gamma curve and a second gamma curve, and luminance of a first image (H) of one of the double frames according to the first gamma curve is not lower than luminance of a second image (L) another of the double frames according to the second gamma curve.

16. The liquid crystal display of claim 15, wherein the performing comprises:

setting a luminance of the input image signal to one of a break condition (Break) in which the luminance of the input image signal is changed on a middle of the TGM mode or a fit condition (Fit) in which the luminance of the input image signal is changed between two adjacent TGM modes; and setting the luminance of the current image signal to one of a rising condition (Rising) in which the luminance of the current image signal is higher than the luminance of the previous image signal or a falling condition (Falling) in which the luminance of the current image signal is lower than the luminance of the previous image signal.

17. The liquid crystal display of claim 16, further comprising:

a comparator configured to compare the previous image signal and the current image signal to generate a flag signal for the set condition, and wherein the post processor post-processes the portion of the plurality of doubled frames to generate the final correction image signal.

18. The liquid crystal display of claim 17, wherein the flag signal has four values according to the set condition for each of the HL-LH mode and the LH-HL mode, and a value of the flag signal for the HL-LH mode forms a pair along with a value of the flag signal for the LH-HL mode and has a same value.

19. The liquid crystal display of claim 17, wherein the weight value is selected using the value of the flag signal.

20. The liquid crystal display of claim 19, wherein the weight value of the rising condition and the fit condition in the HL-LH mode and the weight value of the rising condition and the break condition in the LH-HL mode are equal to or more than 0 and equal to or less than 1, the weight value of the rising condition and the break condition in the HL-LH mode and the weight value of the rising condition and the fit condition in the LH-HL mode are equal to or more than 1, the weight value of the falling condition and the fit condition in the HL-LH mode and the weight value of the falling condition and the break condition in the LH-HL mode are equal to or more than 0 and equal to or less than 1, and the weight value of the falling condition and the break condition in the HL-LH mode and the weight value of the falling condition and the fit condition in the LH-HL mode are equal to or more than 1.

21. The liquid crystal display of claim 17, wherein the DCC unit outputs the correction image signal generated by the first correction of the current image signal to the TGM unit, the TGM unit doubles the correction image signal into the plurality of doubled frame and outputs the doubled correct image signal to the post processor, and the post processor post-processes the correction image signal corresponding to the portion of the plurality of doubled frames using the flag signal from the comparator.

22. The liquid crystal display of claim 17, wherein the DCC unit outputs the correction image signal generated by the first correction of the current image signal to the TGM unit, the comparator adds the flag signal to a lower bit of the correction image signal and outputs the correction image signal added by the flag signal to the TGM unit, the TGM unit doubles the correction image signal added by the flag signal into the plurality of doubled frames and outputs the doubled correction mage signal added by the flag signal to the post processor, and the post processor post-processes the correction image signal corresponding to the portion of the plurality of doubled frames using the flag signal added to the lower bit of the correction image signal.

23. The liquid crystal display of claim 17, wherein the TGM unit doubles the current image signal into the plurality of doubled frames and outputs the doubled current image signal to the DCC unit, the DCC unit outputs the correction image signal generated by the first correction of the doubled current image signal to the post processor, and the post processor post-processes the correction image signal corresponding to the portion of the plurality of doubled frames using the flag signal from the comparator.

24. The liquid crystal display of claim 17, wherein the TGM unit doubles the current image signal into the plurality of doubled frames and outputs the doubled current image signal to the DCC unit, the comparator adds the flag signal to the lower bit of the previous image signal and outputs the previous image signal added by the flag signal to the DCC unit, the DCC unit outputs the correction image signal generated by the first correction of the doubled current image signal to the post processor, and the post processor post-processes the correction image signal corresponding to the portion of the plurality of doubled frames using the flag signal added to the lower bit of the previous image signal.

25. A method of processing an image signal of a liquid crystal display, comprising:

performing a dynamic capacitance compensation (DCC) and a doubling based on a current image signal to generate a correction image signal comprising a plurality of doubled frames; and post-processing the correction image signal corresponding to a portion of the plurality of doubled frames to generate a final correction image signal, wherein the performing comprise:

doubling the current image signal according to a temporal gamma mixing TGM mode;

comparing the current image signal and a previous image signal to generate a flag;

appending the flag to the previous image signal to generate a modified previous image signal; and performing the DCC on a result of the doubling and the modified previous image signal.

* * * * *